US009597871B2

(12) United States Patent
Ike

(10) Patent No.: US 9,597,871 B2
(45) Date of Patent: Mar. 21, 2017

(54) BASE, LIQUID DISCHARGE HEAD, PRINTING APPARATUS, AND METHOD FOR DETERMINING LIQUID DISCHARGE STATUS

(71) Applicant: CANON KABUSHIKI KAISHA, Tokyo (JP)

(72) Inventor: Takeshi Ike, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/695,318

(22) Filed: Apr. 24, 2015

(65) Prior Publication Data

US 2015/0321470 A1 Nov. 12, 2015

(30) Foreign Application Priority Data

May 9, 2014 (JP) ..... 2014-098051

(51) Int. Cl.
*B41J 2/045* (2006.01)
*B41J 2/14* (2006.01)

(52) U.S. Cl.
CPC ..... *B41J 2/14153* (2013.01); *B41J 2/0451* (2013.01); *B41J 2/0454* (2013.01); *B41J 2/0458* (2013.01); *B41J 2/04563* (2013.01); *B41J 2/04585* (2013.01); *B41J 2/14427* (2013.01); *B41J 2002/14354* (2013.01)

(58) Field of Classification Search
CPC .... B41J 2/0454; B41J 2/0451; B41J 2/04585; B41J 2/14153; B41J 2/04563; B41J 2/0458; B41J 2/14427; B41J 2002/14354
See application file for complete search history.

(56) References Cited

U.S. PATENT DOCUMENTS 5,175,565 A * 12/1992 Ishinaga ..... B41J 2/0451 347/17
5,975,669 A * 11/1999 Ohshima ..... B41J 2/04528 347/14
7,722,148 B2 * 5/2010 Takabayashi ..... B41J 2/04541 347/14
7,950,765 B2 5/2011 Takabayashi et al.
(Continued)

FOREIGN PATENT DOCUMENTS

JP 2007-290361 A 11/2007
JP 2008-000914 A 1/2008

*Primary Examiner* — Julian Huffman
*Assistant Examiner* — Michael Konczal
(74) *Attorney, Agent, or Firm* — Fitzpatrick, Cella, Harper & Scinto

(57) ABSTRACT

An embodiment of this invention is directed to determining a discharge status of liquid discharged from a liquid discharge head capable of accurately determining the discharge status of each nozzle at high speed with a simple arrangement. According to the embodiment, a base includes an electrothermal transducer configured to supply heat to liquid, a first temperature detection element configured to detect the temperature of the electrothermal transducer, and a second temperature detection element configured to detect the temperature of the same electrothermal transducer. In this case, the first and the second temperature detection elements are arranged so that at least part of each of the first and second temperature detection elements is included immediately above or below a region where the electrothermal transducer is arranged in the base.

18 Claims, 19 Drawing Sheets

(56) References Cited

U.S. PATENT DOCUMENTS

| | | | | |
|---|---|---|---|---|
| 8,172,355 | B2 | 5/2012 | Takabayashi et al. | |
| 8,186,798 | B2 * | 5/2012 | Aoki | B41J 2/04563 347/14 |
| 8,733,876 | B2 | 5/2014 | Ike | |
| 8,845,064 | B2 | 9/2014 | Ike | |
| 8,870,333 | B2 * | 10/2014 | Yasutani | B41J 2/0454 347/14 |
| 2014/0076988 | A1 * | 3/2014 | Rasa | B41J 2/04515 239/13 |
| 2014/0204146 | A1 * | 7/2014 | Toyama | B41J 2/04563 347/17 |
| 2014/0292891 | A1 | 10/2014 | Ike | |
| 2014/0300657 | A1 | 10/2014 | Ike | |

* cited by examiner

DISCHARGE FAILURE

NORMAL DISCHARGE

NORMAL DISCHARGE

DISCHARGE FAILURE (NON-DISCHARGE CAUSED BY BUBBLE)

BASE, LIQUID DISCHARGE HEAD, PRINTING APPARATUS, AND METHOD FOR DETERMINING LIQUID DISCHARGE STATUS

BACKGROUND OF THE INVENTION

Field of the Invention

The present invention relates to a base, a liquid discharge head, a printing apparatus, and a method for determining an ink discharge status and, particularly, to a printing apparatus which uses a liquid discharge head including heating elements (heaters) for discharging liquid such as ink, and a method for determining a liquid discharge status.

Description of the Related Art

One of inkjet printing methods for discharging ink droplets from nozzles and adhering them to a print medium such as paper or a plastic film uses a liquid discharge head including heaters configured to generate heat energy for discharging ink. For the liquid discharge head according to this method, an electrothermal transducer which generates heat in accordance with energization, a driving circuit, and the like can be formed by a process similar to a semiconductor manufacturing process. Therefore, high-density integration of nozzles is easy, and high-resolution printing can be implemented.

In this liquid discharge head, ink discharge failure may occur in all or some nozzles of the liquid discharge head due to nozzle clogging caused by a foreign substance, ink of high viscosity, or the like, a bubble entering an ink supply channel or nozzle, a change in wettability of a nozzle surface, or the like. To avoid degradation of the image quality in a case where such discharge failure occurs, it is desirable to quickly execute a recovery operation of recovering the ink discharge status, and a complementary operation using another nozzle or the like. However, to quickly perform these operations, it is very important to determine the ink discharge status and occurrence of discharge failure accurately and timely.

Hence, there have conventionally been proposed various methods for determining the ink discharge status and apparatuses to which these methods are applied.

Japanese Patent Laid-Open No. 2007-290361 discloses a method for comparing, with a predetermined threshold, the highest temperature in ink discharge, which has been detected by a temperature detection element provided immediately below a heater, in order to detect the ink discharge status. When ink is normally discharged, heat is transferred from the heater together with discharged ink droplets. To the contrary, in an ink discharge failure, no ink is discharged, and thus heat is accumulated in an interlayer insulation film to raise the highest temperature. In accordance with a difference in highest temperature, it is possible to detect the ink discharge status.

To detect a discharge failure, Japanese Patent Laid-Open No. 2008-000914 discloses a method for detecting a decrease in temperature in normal discharge. In normal discharge, part of a discharged ink droplet comes into contact with an anti-cavitation film, and the temperature of a temperature detection element abruptly lowers. To the contrary, in ink discharge failure, no ink droplet comes into contact with the anti-cavitation film, and the temperature of the temperature detection element gradually lowers. Therefore, in accordance with a difference in temperature change, it is possible to detect the discharge status.

In the discharge status determination method disclosed in Japanese Patent Laid-Open No. 2007-290361, however, since the reached highest temperature changes depending on the temperature of the liquid discharge head, applied energy, a difference in resistance value of the temperature detection element, or the like, a determination threshold according to each condition is required.

In the arrangement disclosed in Japanese Patent Laid-Open No. 2008-000914, to detect an abrupt decrease in temperature, the peak of the temperature change is emphasized by executing a plurality of calculation processes such as differential processing for the detected temperature. Thus, it takes time to perform processing up to determination. Furthermore, the circuit scale becomes large due to the calculation processing.

SUMMARY OF THE INVENTION

Accordingly, the present invention is conceived as a response to the above-described disadvantages of the conventional art.

For example, a base, a liquid discharge head, a printing apparatus, and a method for determining a liquid discharge status according to this invention are capable of accurately determining the discharge status of liquid such as ink at high speed with a simpler arrangement.

According to one aspect of the present invention, there is provided a base comprising: an electrothermal transducer configured to supply heat to liquid; a first temperature detection element configured to detect a temperature of the electrothermal transducer; and a second temperature detection element configured to detect a temperature of the electrothermal transducer, wherein the first temperature detection element and the second temperature detection element are arranged so that at least part of each of the first temperature detection element and the second temperature detection element is included immediately above or below a region where the electrothermal transducer is arranged in the base.

According to another aspect of the present invention, there is provided a liquid discharge head for discharging ink, using the above-mentioned base wherein the first temperature detection element and the second temperature detection element are resistors, and the above base further comprises a comparator configured to compare a first output voltage and a second output voltage respectively obtained from the first temperature detection element and the second temperature detection element by supplying an electric current to each of the first temperature detection element and the second temperature detection element from outside.

According to still another aspect of the present invention, there is provided a printing apparatus for printing, using the above-mentioned liquid discharge head, comprising: an electric current supply source configured to supply an electric current to the first temperature detection element and the second temperature detection element; and a determination unit configured to determine, based on a voltage output from the comparator, whether discharge failure occurs or liquid is normally discharged by supplying heat by the electrothermal transducer corresponding to the first temperature detection element and the second temperature detection element.

According to still another aspect of the present invention, there is provided a method for determining a liquid discharge status in a printing apparatus for printing, using the above-mentioned liquid discharge head, comprising: supplying an electric current to the first temperature detection element and the second temperature detection element; and determining, based on a voltage output from the comparator, whether discharge failure occurs or liquid is normally discharged by supplying heat by an electrothermal transducer corresponding to the first temperature detection element and the second temperature detection element.

The invention is particularly advantageous since it is possible to accurately determine the liquid discharge status at high speed with a simple arrangement.

Further features of the present invention will become apparent from the following description of exemplary embodiments (with reference to the attached drawings).

DESCRIPTION OF THE EMBODIMENTS

Exemplary embodiments of the present invention will now be described in detail in accordance with the accompanying drawings.

In this specification, the terms "print" and "printing" not only include the formation of significant information such as characters and graphics, but also broadly include the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as "liquid" hereinafter) should be extensively interpreted similar to the definition of "print" described above. That is, "ink" includes liquid which, when applied onto a print medium, can form images, figures, patterns, and the like, can process the print medium, and can process ink. The process of ink includes, for example, solidifying or insolubilizing a coloring agent contained in ink applied to the print medium.

In addition, "a printing element" is a general term for a nozzle (or orifice), a channel communicating with the nozzle, and a device for generating energy to be used to discharge ink, unless otherwise specified.

<Description of Printing Apparatus (FIG. 1)>

The arrangement of an inkjet printing apparatus (to be referred to as a printing apparatus hereinafter) commonly applicable to some embodiments to be described below will be explained below.

Figure 1:
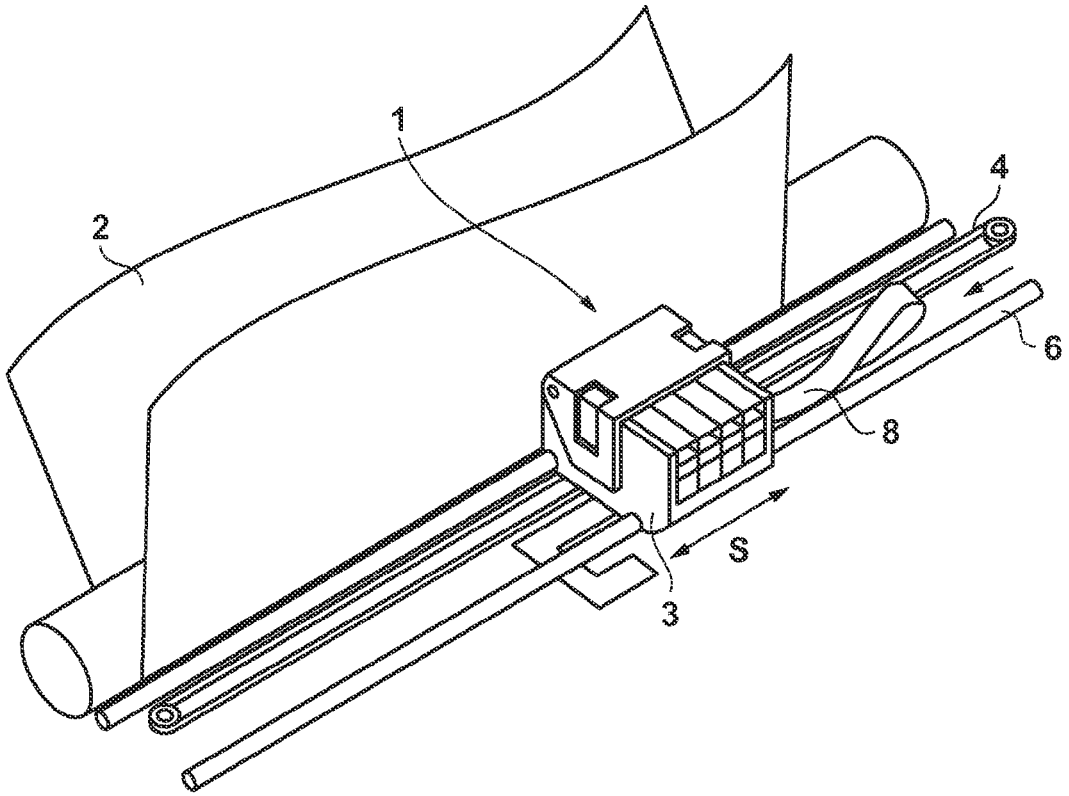
FIG. 1 is a perspective view showing the main mechanical portion of an inkjet printing apparatus according to an exemplary embodiment of the present invention.

FIG. 1 is a perspective view showing, as an exemplary embodiment of the present invention, an overview of the main mechanism portion of a printing apparatus in which an inkjet liquid discharge head (to be referred to as a liquid discharge head hereinafter) is mounted to discharge liquid such as ink to a print medium and perform printing. As shown in FIG. 1, a liquid discharge head 1 is mounted on a carriage 3. The carriage 3 is guided and supported to be reciprocally movable in a direction indicated by an arrow S along a guide rail 6 in accordance with rotation of a timing belt 4. The liquid discharge head 1 includes, on a surface facing a print medium 2, a group of nozzles arrayed in a direction different from the moving direction of the carriage 3. In a process of reciprocal scanning of the carriage 3 with the liquid discharge head 1 mounted in the direction of the arrow S, the nozzle group of the liquid discharge head 1 discharges ink in accordance with print data, thereby performing printing on the print medium 2.

A plurality of liquid discharge heads 1 can be provided in consideration of discharging inks of a plurality of colors. For example, printing can be performed using cyan (C), magenta (M), yellow (Y), and black (Bk) inks. The liquid discharge head 1 may integratedly include an inseparable ink tank storing ink, or may be connected to a separable ink tank storing ink. Alternatively, the liquid discharge head 1 may receive ink, via a tube or the like, supplied from an ink tank provided at a fixed portion of the apparatus. The carriage 3 is provided with an electrical connection portion for transmitting a driving signal or the like to the liquid discharge head 1 via a flexible cable 8 and a connector.

Although not illustrated in FIG. 1, a recovery unit used to maintain or recover the ink discharge operation of the nozzles of the liquid discharge head to a satisfactory status is provided within the moving range of the liquid discharge head and outside the printing range of the print medium 2. A recovery unit having a known arrangement can be adopted. For example, the recovery unit can include a cap which caps the nozzle formation surface of the liquid discharge head, and a pump which forcibly discharges the ink from the nozzles into the cap by applying a negative pressure in the capping status. The recovery unit may perform discharge (preliminary discharge) of ink into, for example, the cap, which does not contribute to image printing.

<Arrangement of Liquid Discharge Head (FIGS. 2A and 2B)>

Figure 2A:
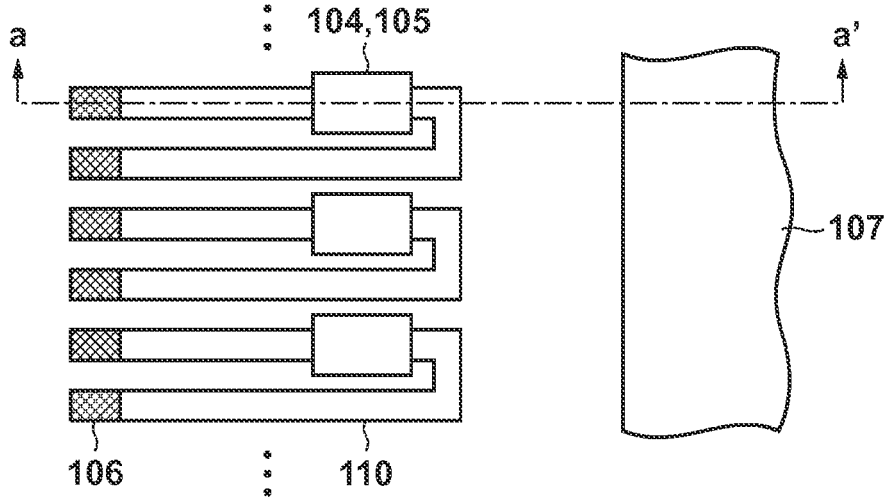
FIGS. 2A and 2B are a schematic plan view showing part of the base (heater board) of an inkjet liquid discharge head including temperature detection elements, and a schematic sectional view taken along a line a-a', respectively.
Figure 2B:
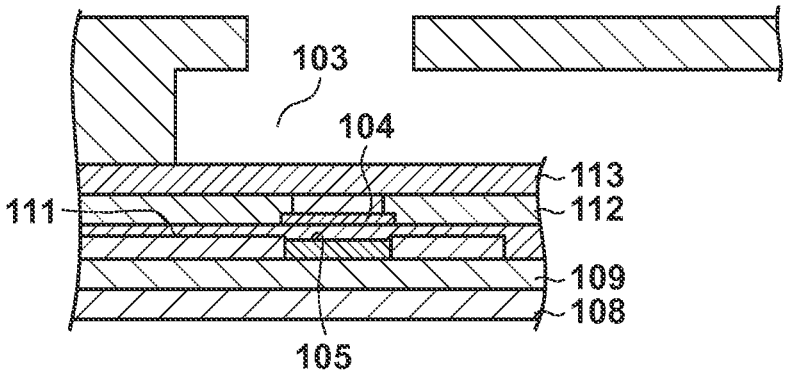

FIGS. 2A and 2B are a schematic plan view showing part of the base (heater board) of the liquid discharge head including temperature detection elements and a schematic sectional view taken along a line a-a', respectively.

Electric power is supplied by a driving pulse signal to cause each of a plurality of nozzles 103, which are arrayed, to discharge ink. In response to this, electrothermal transducers (to be referred to as heaters hereinafter) 104 are heated to cause, for example, film boiling in ink, thereby discharging ink droplets from the respective nozzles.

Referring to the plan view of FIG. 2A, terminals 106 are connected to the outside by wire bonding to supply power. Temperature detection elements (to also be referred to as temperature sensors hereinafter) 105 are formed on the heater board by the same film forming process as that for the heaters 104. Reference numeral 107 denotes a common liquid chamber.

As shown in the sectional view of FIG. 2B, the temperature sensor 105 formed from a film resistor whose resistance value changes in accordance with the temperature is arranged on a heat-storage layer 109 made of a thermal oxide film of $SiO_2$ or the like on an Si base 108 forming the heater board. The temperature sensor 105 is made of Al, Pt, Ti, Ta, Cr, W, AlCu, or the like. Furthermore, an interconnection 110 of Al or the like including an individual interconnection for the heater 104, the heater 104, and an interconnection which connects the heater 104 and a control circuit for selectively supplying power to it is formed on the Si substrate 108. In addition, the heater 104, a passivation film 112 of SiN or the like, and an anti-cavitation film 113 are laminated and arranged on an interlayer insulation film 111 at high density by a process similar to a semiconductor manufacturing process. Note that Ta or the like can be used for the anti-cavitation film 113 in order to increase the anti-cavitation capability on the heater 104.

As is apparent from the above-described structure, the Si base 108 has a multilayer structure. The temperature sensors 105 are formed in a layer different from that in which the heaters 104 are formed, and the interlayer insulation film 111 is formed between the layers. For the sake of simplicity, one temperature sensor is formed in correspondence with each heater 104. However, two temperature sensors can be formed in correspondence with one heater, as will be described in the following embodiments.

<Control Arrangement (FIG. 3)>

Figure 3:
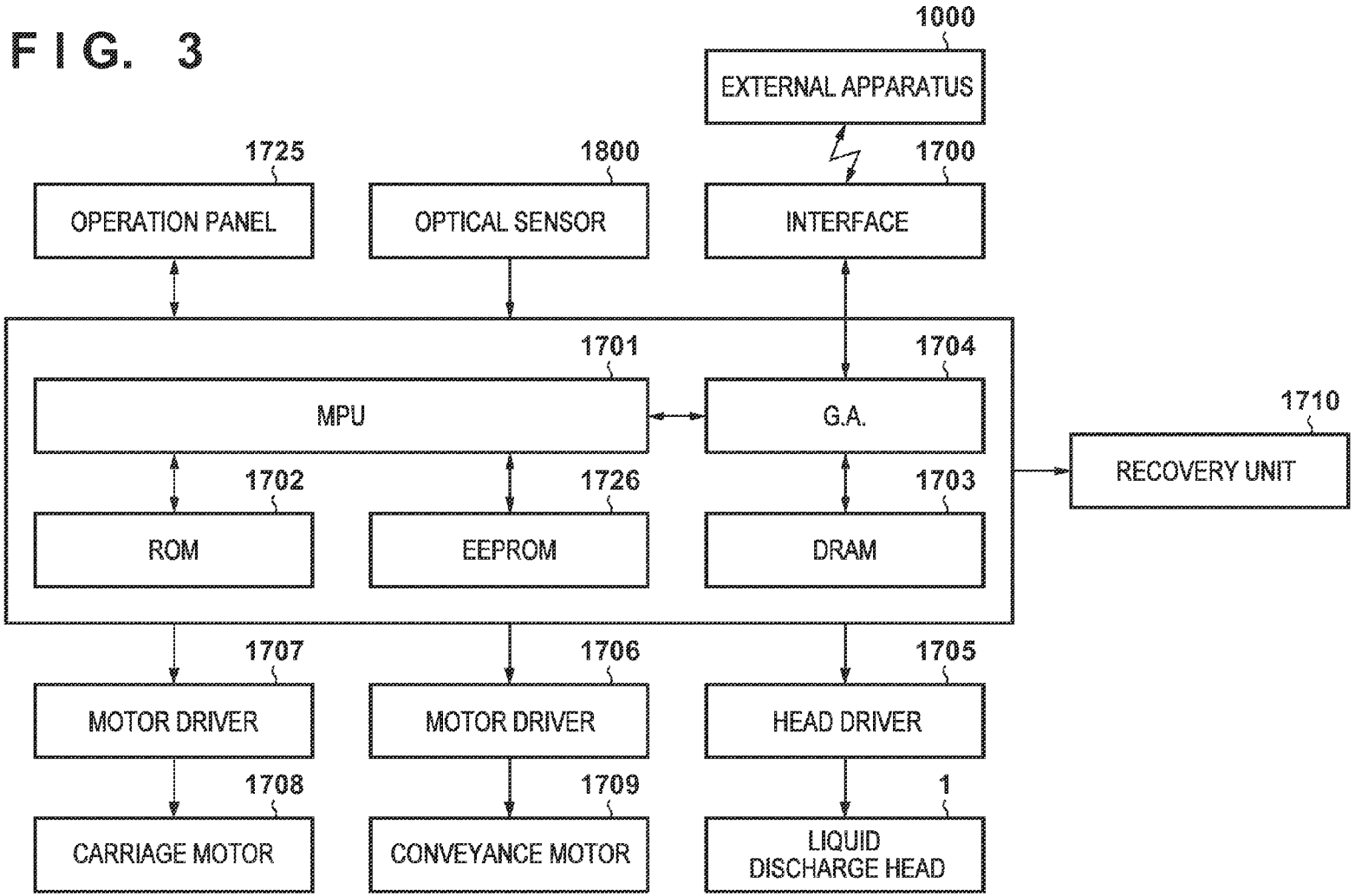
FIG. 3 is a block diagram showing the control arrangement of a printing system including the printing apparatus shown in FIG. 1.

FIG. 3 is a block diagram showing the control arrangement of a printing system including the printing apparatus shown in FIG. 1.

Referring to FIG. 3, an interface 1700 receives a command or a print signal including image data sent from an external apparatus 1000 having the form of a host computer or other device as needed. In addition, the interface 1700 can send the status information of the printing apparatus to the external apparatus 1000, as needed. An MPU 1701 controls the respective units of the printing apparatus in accordance with necessary data and control programs corresponding to processing procedures (to be described later), which are stored in a ROM 1702.

A DRAM 1703 saves various data (the print signal, print data to be supplied to the liquid discharge head, and the like). A gate array (G.A.) 1704 controls supply of print data to the liquid discharge head 1, and also controls data transfer between the interface 1700, the MPU 1701, and the DRAM 1703. A nonvolatile memory 1726 such as an EEPROM is used to save necessary data even upon power-off of the printing apparatus.

A carriage motor 1708 is used to reciprocally move the carriage 3 in the direction of the arrow S, as shown in FIG. 1. A conveyance motor 1709 is used to convey the print medium 2. A head driver 1705 drives the liquid discharge head 1. Motor drivers 1706 and 1707 drive the conveyance motor 1709 and the carriage motor 1708, respectively. A recovery unit 1710 can include the above-described cap, pump, and the like. An operation panel 1725 includes a setting input unit for allowing an operator to make various settings in the printing apparatus, and a display unit for displaying a message to the operator. An optical sensor 1800 detects the conveyance position of the print medium and the like.

To detect the temperature of each heater, it is necessary to supply power to the temperature sensor via the terminal 106, detect the voltage of the temperature sensor, and output the voltage. Therefore, the carriage 3 includes a terminal for supplying power and a terminal for receiving an output voltage from the temperature sensor. Furthermore, the power supplied via the terminal is supplied from the main body of the printing apparatus via the flexible cable 8, and the output voltage from the temperature sensor is output to the main body of the printing apparatus via the flexible cable 8.

Based on temperature information obtained via the flexible cable 8, the main body of the printing apparatus can determine whether each nozzle has normally discharged ink or discharge failure has occurred.

<Relationship Between Discharge Status and Temperature of Interlayer Insulation Film>

The liquid discharge head to which the present invention is applied basically includes a heating element (heater) for generating heat energy to discharge ink, and a temperature detection element (temperature sensor) for detecting a temperature change along with driving of the heater.

Figure 4A:
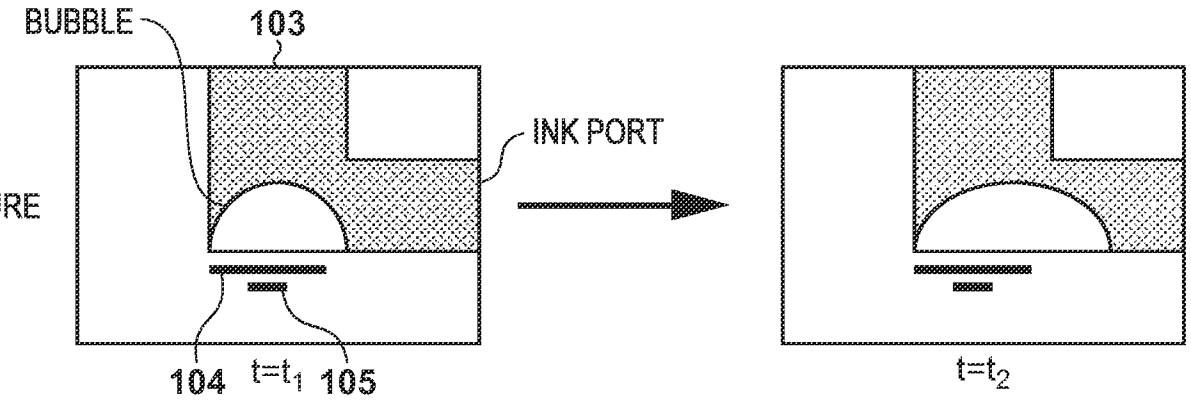
FIGS. 4A and 4B are views, respectively, showing an ink status in a nozzle in a case where ink is normally discharged and that in a case where discharge failure occurs.
Figure 4B:
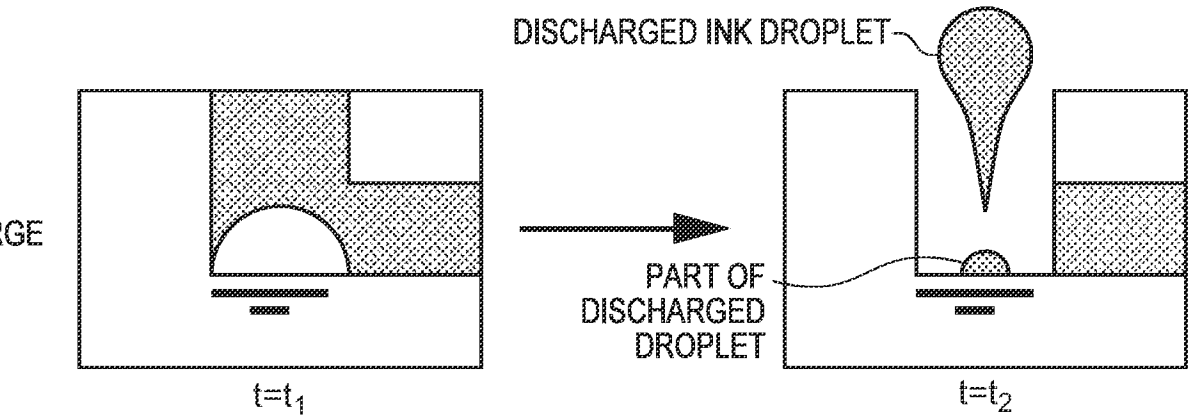

FIGS. 4A and 4B are views, respectively, showing an ink status in a nozzle in a case where ink is normally discharged and that in a case where ink discharge failure occurs. Especially, FIGS. 4A and 4B each show the status on the anti-cavitation film 113 in accordance with the discharge status.

As shown in FIGS. 4A and 4B, at an elapsed time $t=t_1$ after heating the heater 104, in ink discharge failure (FIG. 4A) and in normal discharge (FIG. 4B), a bubble caused by heating covers the anti-cavitation film. At $t=t_2$ after a given time further elapses, in ink discharge failure (FIG. 4A), the bubble remains on the anti-cavitation film. On the other hand, in normal discharge (FIG. 4B), part of a discharged ink droplet generated along with discharge comes into contact with the surface of the anti-cavitation film.

Figure 5:
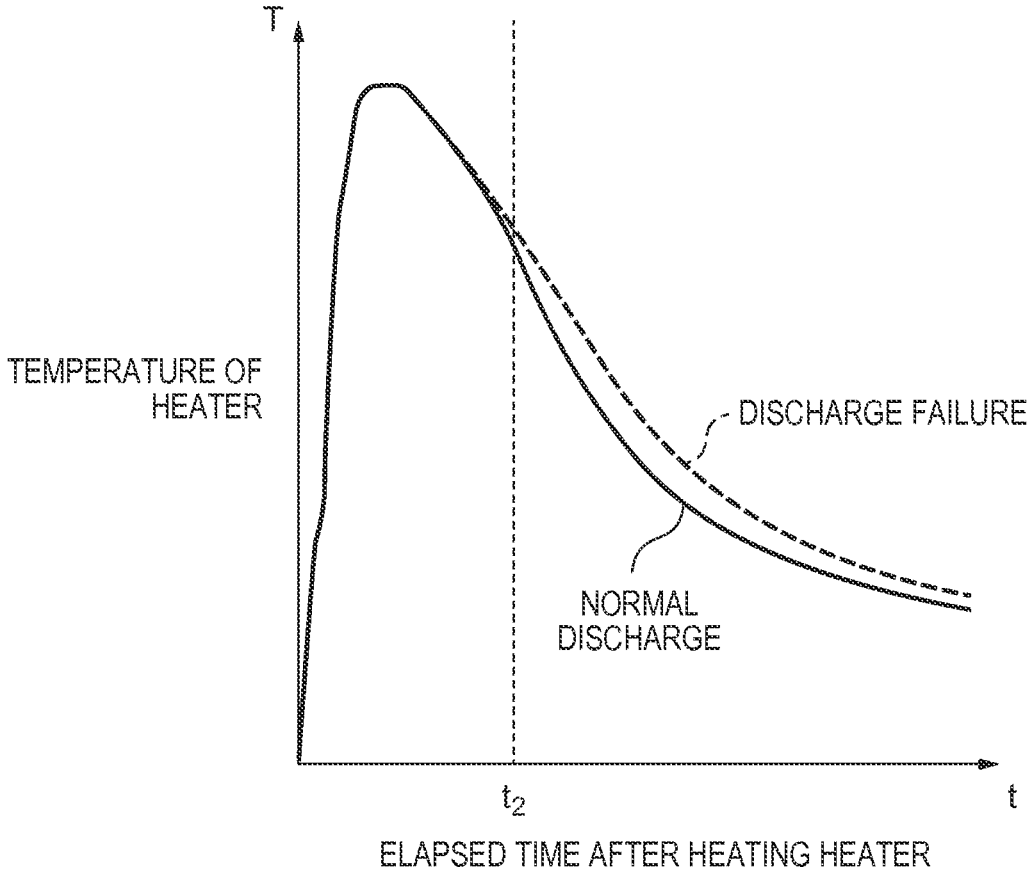
FIG. 5 is a graph showing a temperature change detected by a temperature sensor in a case where ink is normally discharged and that in a case where discharge failure occurs.

FIG. 5 is a graph showing a temperature change detected by the temperature sensor 105 in a case where ink is normally discharged and that in a case where ink discharge failure occurs. Especially, FIG. 5 shows a temperature change under the surface of the anti-cavitation film 113 in the discharge operation. Furthermore, $t=t_2$ in FIG. 5 corresponds to $t=t_2$ in FIGS. 4A and 4B.

Referring to FIG. 5, since a bubble always exists on the surface of the anti-cavitation film in ink discharge failure, no abrupt temperature change occurs, and the temperature gradually lowers. On the other hand, in normal ink discharge, the heat is transferred to the ink side at a timing of $t=t_2$, and thus the temperature of the surface of the anti-cavitation film abruptly lowers.

Several embodiments in which the ink discharge status is determined in consideration of the printing apparatus having the above arrangement and the characteristics of a temperature change of the heater in an ink discharge operation will be described next.

First Embodiment

Figure 6A:
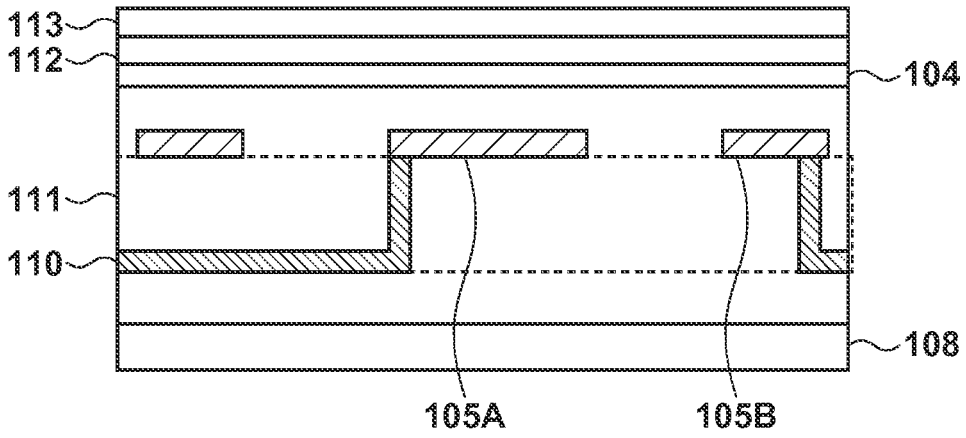
FIGS. 6A and 6B are a side sectional view and plan view, respectively, showing the arrangement of temperature detection elements and a heater according to the first embodiment of the present invention.
Figure 6B:
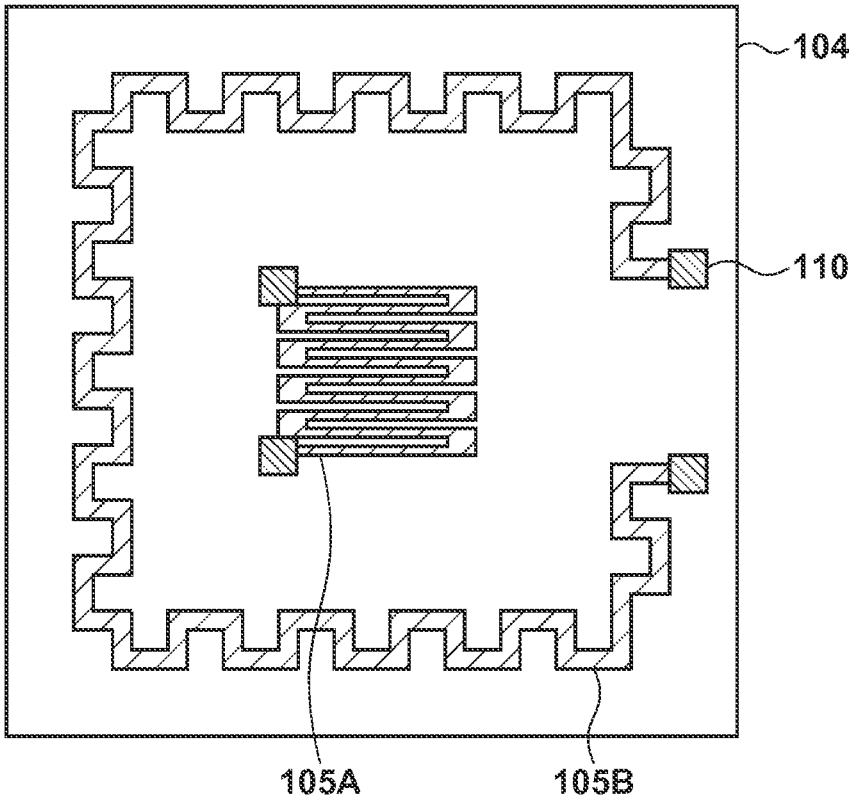

FIGS. 6A and 6B are a side sectional view and plan view, respectively, showing the arrangement of temperature detection elements and a heater according to the first embodiment of the present invention.

As shown in FIGS. 6A and 6B, in this embodiment, two temperature detection elements (temperature sensors) 105A and 105B are provided for one heater. The two temperature detection elements (temperature sensors) formed as film resistors as described above are arranged immediately below one heater 104. This makes it possible to measure the temperature at two positions immediately below the heater, at which temperature changes are different from each other.

As shown in FIG. 6A, an interconnection connected to each temperature detection element is connected to an interconnection 110 in a layer different from that of the temperature detection element across the layer. By providing the interconnection in another layer, heat transferred via the interconnection between the two temperature detection elements 105A and 105B in the same layer is reduced, thereby allowing accurate measurement of the temperature at locations at which the temperature detection elements are arranged.

As exemplified in FIG. 6B as well, the planar shapes of the two temperature detection elements 105A and 105B are determined, as needed. In the example shown in FIG. 6B, the first temperature detection element 105A is arranged at the center of the heater 104, and the second temperature detection element 105B is arranged along the periphery of the heater 104.

This arrangement makes it possible to simultaneously detect a large temperature change in the central portion caused by the contact of part of an ink droplet discharged to the center of the surface of an anti-cavitation film 113 (the center of the heater 104), and a small temperature change in the periphery where no ink droplet comes into contact. Furthermore, by arranging the two temperature detection elements 105A and 105B in a meandering pattern, it is possible to increase the resistances of the elements and detect a small temperature change as a larger change.

Figure 7:
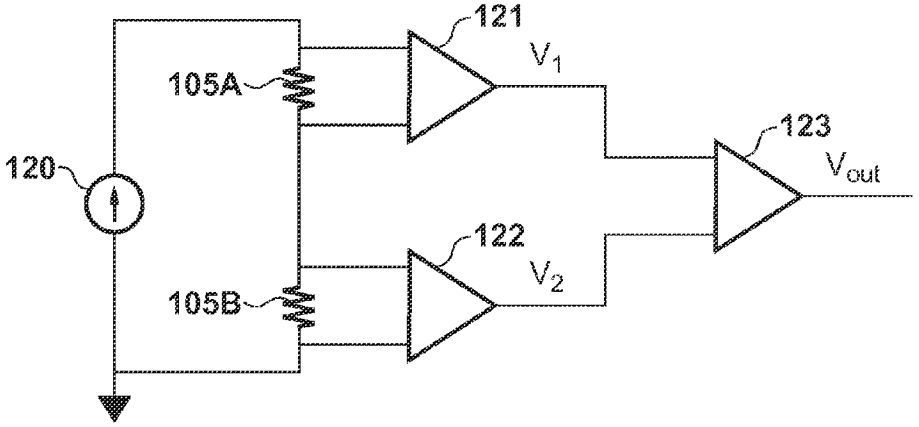
FIG. 7 is a circuit diagram showing the arrangement of a temperature detection circuit according to the first embodiment of the present invention.

FIG. 7 is a circuit diagram showing the arrangement of a temperature detection circuit according to the first embodiment of the present invention.

As is apparent from the arrangement shown in FIGS. 6A and 6B, the first temperature detection element 105A is arranged immediately below the center of the heater 104, and the second temperature detection element 105B is arranged immediately below the periphery of the heater 104. An electric current supply source 120 for causing a constant current to flow through each temperature detection element is provided outside an Si base 108. When an electric current flows through each temperature detection element, a change in resistance value caused by a temperature change can be output as a voltage. A differentiator 121 or 122 provided in correspondence with each temperature detection element extracts the voltage generated in the temperature detection element. A comparator 123 compares the voltages ($V_1$ and $V_2$) obtained from the two temperature detection elements. Finally, an output voltage $V_{out}$ from the comparator 123 is output as temperature information of the one heater 104.

Note that the circuit having the above arrangement except for the electric current supply source 120 is integrated in the Si base 108. Note also that such circuit need not always be integrated in the Si base 108, and may be implemented outside the Si base 108, for example, in the carriage 3 or the control circuit of the main body of the printing apparatus. However, in consideration of noise mixture in the detected voltage, signal attenuation, laying of an external interconnection, and the like, it is the best mode to integrate the circuit in the Si base 108.

Although the first and second temperature detection elements 105A and 105B have been described to be arranged immediately below the heater 104, this merely represents the relative positional relationship. In a case where the liquid discharge head 1 integrating the Si base 108 is mounted on the carriage 3, the first and second temperature detection elements 105A and 105B may be described to be arranged immediately above the heater 104 depending on the attachment positional relationship.

Furthermore, FIGS. 6A and 6B exemplify a case in which the two temperature detection elements are completely included in the region of the one heater. As long as it is possible to detect the temperature of one corresponding heater, only part of each of two temperature detection elements may be included in the region of the one heater. The terms "immediately below" and "immediately above" include not only a case in which two temperature detection elements are completely included in the region of one heater but also a case in which the two elements are arranged so that part of each of the two elements is included in the region.

Figure 8B:
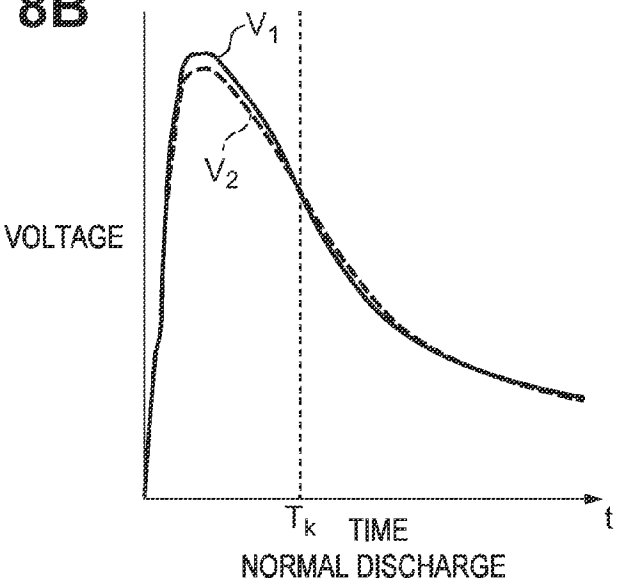
FIGS. 8A and 8B are graphs showing temporal changes in voltages of two temperature detection elements in ink discharge failure and those in normal discharge, respectively, in a case where the temperature detection circuit shown in FIG. 7 is used.
Figure 8A:
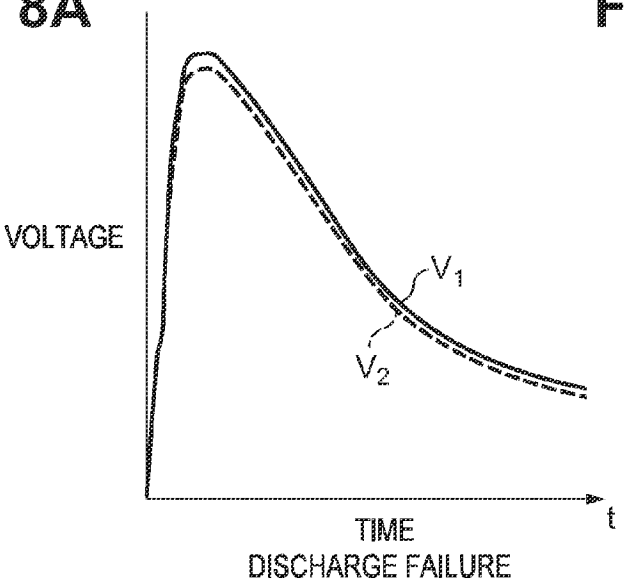

FIGS. 8A and 8B are graphs showing temporal changes in voltages obtained from the two temperature detection elements 105A and 105B in ink discharge failure and those in normal discharge, respectively, in a case where the temperature detection circuit shown in FIG. 7 is used.

In ink discharge failure, the temperature of the second temperature detection element 105A is always higher than that of the second temperature detection element 105B. As shown in FIG. 8A, therefore, the voltage $V_1$ of the first temperature detection element is higher than the voltage $V_2$ of the second temperature detection element. To the contrary, in normal ink discharge after time $T=T_k$, the temperature of the first temperature detection element 105A is lower than that of the second temperature detection element 105B. Consequently, the voltage $V_1$ of the first temperature detection element 105A is lower than the voltage $V_2$ of the second temperature detection element 105B. Note that in normal ink discharge, $T_k$ represents the timing at which part of a discharged ink droplet comes into contact with the center of the anti-cavitation film 113.

Figure 9:
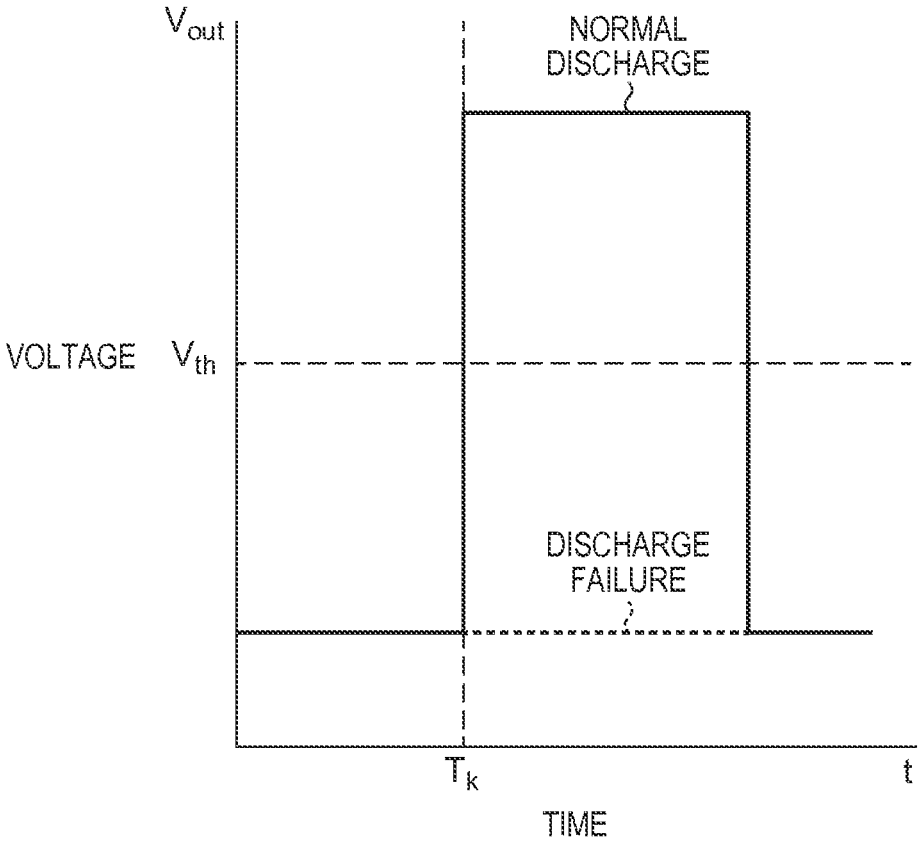
FIG. 9 is a graph showing a temporal change in output voltage from a comparator in ink discharge failure and that in normal discharge in a case where the temperature detection circuit shown in FIG. 7 is used.

FIG. 9 is a graph showing a temporal change in output voltage from a comparator in ink discharge failure and that in normal discharge in a case where the temperature detection circuit shown in FIG. 7 is used.

If $V_2 \geq V_1$, the output signal $V_{out}$ of the comparator 123 is at high level. On the other hand, if $V_2 < V_1$, the output signal $V_{out}$ is at low level. In ink discharge failure, $V_1 > V_2$ always holds, and thus the output signal $V_{out}$ from the comparator 123 is always at low level and is constant. On the other hand, in normal ink discharge, $V_1 > V_2$ holds at the time of bubbling, and the output signal $V_{out}$ is at low level. However, after time $T_k$, $V_1 < V_2$ holds, and thus the output signal $V_{out}$ is at high level. Note that $T_k$ represents the timing at which a discharged ink droplet comes into contact with the center of the anti-cavitation film 113.

According to the above-described embodiment, it is possible to determine normal ink discharge or ink discharge failure by monitoring temporal changes in output voltages from the two temperature detection elements 105A and 105B. Note that the printing apparatus receives the output voltage $V_{out}$ from the comparator 123 as temperature information of the one heater 104. As shown in FIG. 9, therefore, the output voltage $V_{out}$ is compared with a predetermined threshold $V_{th}$, and normal ink discharge or an ink discharge failure is determined according to the magnitude relationship. That is, after time $T_k$, if $V_{out} \geq V_{th}$, normal discharge is determined; otherwise, a discharge failure is determined.

Second Embodiment

In this embodiment, a case in which the temperature detection circuit described in the first embodiment is driven by using two electric current supply sources will be explained.

Figure 10:
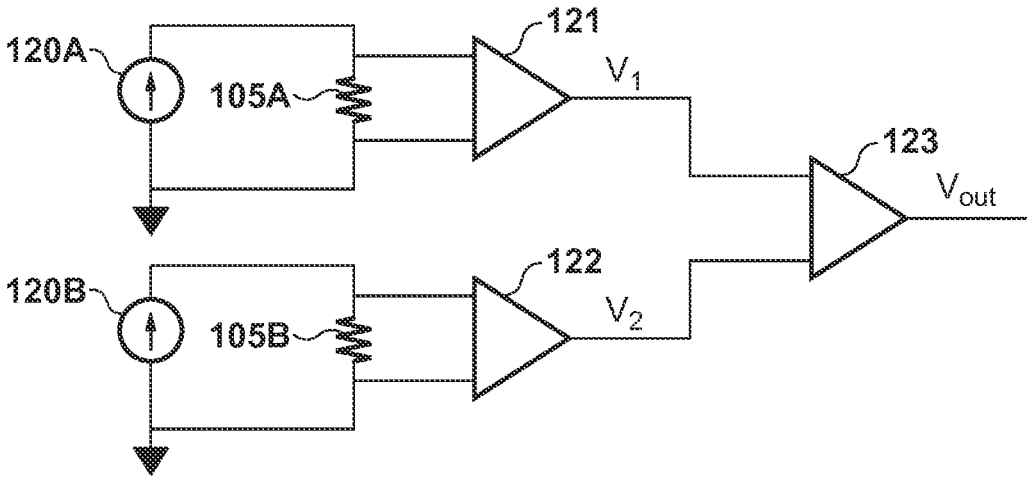
FIG. 10 is a circuit diagram showing the arrangement of a temperature detection circuit according to the second embodiment of the present invention.

FIG. 10 is a circuit diagram showing the arrangement of a temperature detection circuit according to the second embodiment of the present invention.

The same reference numerals as those in FIG. 7 denote the same components in FIG. 10 and a description thereof will be omitted. As will be apparent by comparing FIGS. 10 and 7 with each other, in this embodiment, individual electric current supply sources 120A and 120B are provided for respective two temperature detection elements. In this embodiment, therefore, it is possible to control the electric current of each temperature detection element.

Figure 11B:
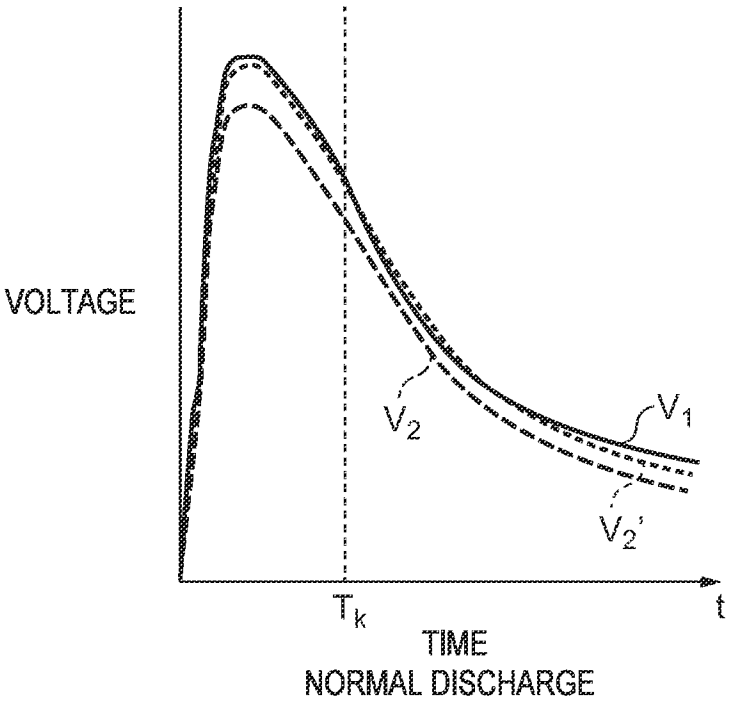
FIGS. 11A and 11B are graphs showing temporal changes in voltages of two temperature detection elements in ink discharge failure and those in normal discharge, respectively, in a case where each of two individual electric current supply sources supplies an electric current by using the temperature detection circuit shown in FIG. 10.
Figure 11A:
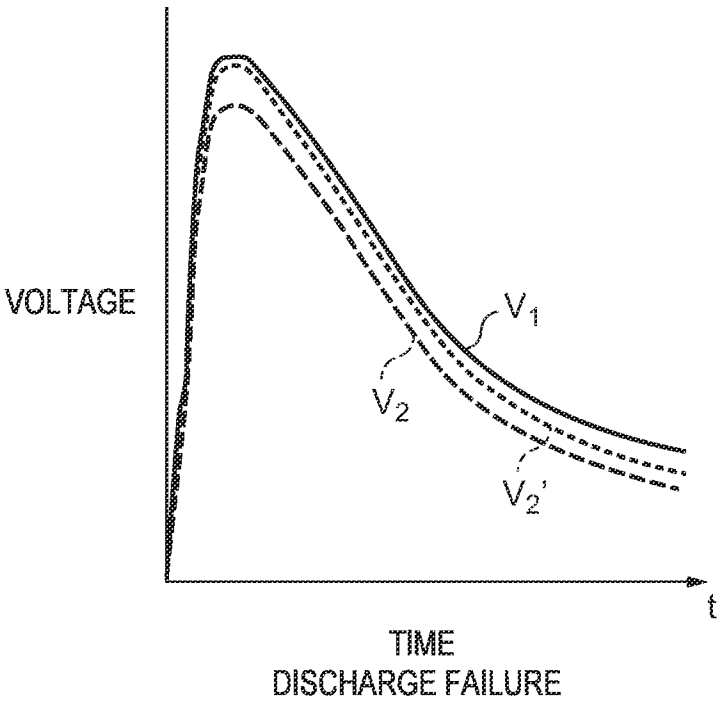

FIGS. 11A and 11B are graphs each showing temporal changes in output voltages from the two temperature detection elements in a case where an electric current supplied from the electric current supply source to the second temperature detection element is increased.

In normal discharge, as shown in FIG. 11B, the magnitude relationship between an output voltage $V_1$ of a first temperature detection element 105A and an output voltage $V_2$ of a second temperature detection element 105B remains unchanged. However, the magnitude relationship between $V_1$ and $V_2$ after time $T_k$ changes by supplying a larger electric current to the second temperature detection element to provide a higher voltage $V_2'$. At this time, as shown in FIG. 11A, in ink discharge failure, the magnitude relationship between the output voltages of the two temperature detection elements is controlled to remain unchanged even if the electric current supplied from the electric current supply source is adjusted.

Note that either the electric current supplied to the first temperature detection element or that supplied to the second temperature detection element may be adjusted.

Figure 12:
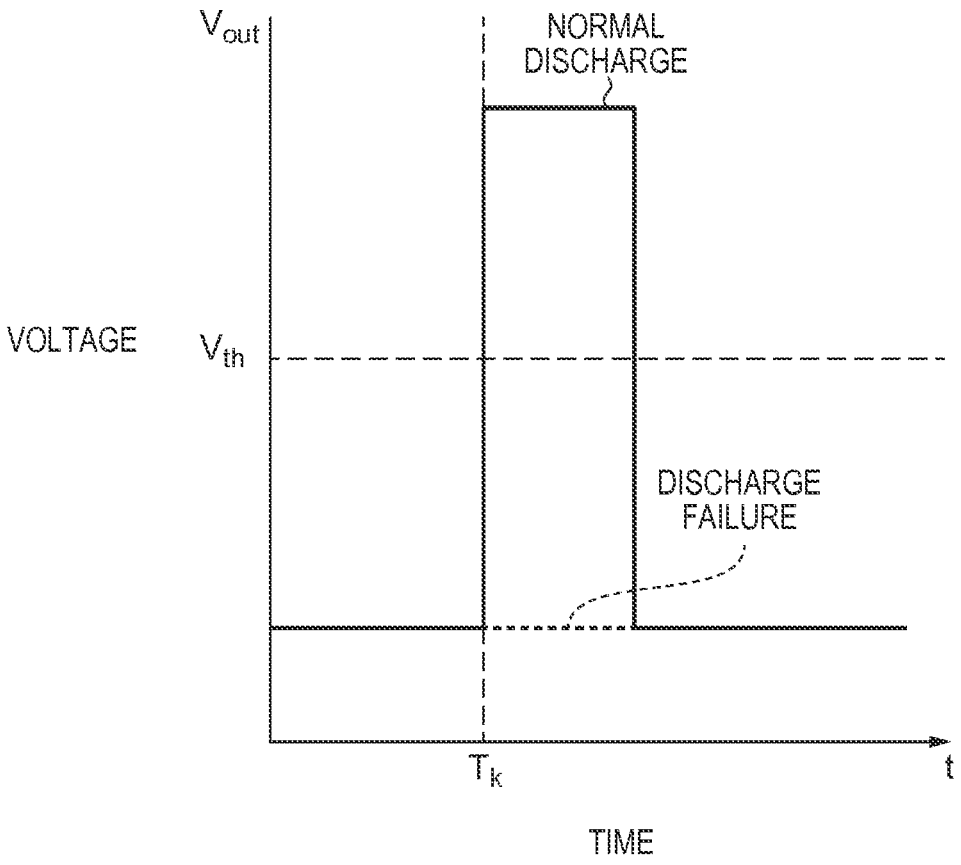
FIG. 12 is a graph showing a temporal change in output voltage from a comparator in ink discharge failure and that in normal discharge in a case where the temperature detection circuit shown in FIG. 10 is used.

FIG. 12 is a graph showing a temporal change in output voltage from the comparator 123 in ink discharge failure and that in normal discharge in a case where the temperature detection circuit shown in FIG. 10 is used.

As shown in FIG. 12, in normal ink discharge, since $V_1 < V_2'$ after time $T_k$, an output signal $V_{out}$ of the comparator 123 is at high level. On the other hand, in ink discharge failure, $V_1 > V_2'$ always holds, the output signal $V_{out}$ is always at low level.

Note that in FIGS. 11A to 12, $T_k$ represents the timing at which a discharged ink droplet comes into contact with the center of an anti-cavitation film.

Due to the locations and manufacturing variations of temperature detection elements, a change in discharge phenomenon, and the like, the magnitude relationship between the output voltages $V_1$ and $V_2$ from the respective temperature detection elements may remain unchanged in normal ink discharge in the arrangement described in the first embodiment. According to the above-described embodiment, however, even in such case, it is possible to change the magnitude relationship between the voltages by adjusting the electric current for each temperature detection element. It is then possible to determine normal discharge or discharge failure in accordance with the difference between the output voltages.

Third Embodiment

In this embodiment, a case in which the ink discharge status is detected according to a voltage difference between two temperature detection elements will be described.

As described above, in normal ink discharge, part of a discharged ink droplet comes into contact with the surface of an anti-cavitation film 113, and thus a temperature difference between a portion immediately below the center of a heater 104 and a portion immediately below the periphery of the heater 104 becomes small. On the other hand, in ink discharge failure, the center and periphery of the heater 104 are in contact with air, the temperature difference between the portion immediately below the center and the portion immediately below the periphery does not become small, unlike normal discharge. In this embodiment, the ink discharge status is detected by detecting the magnitude of the temperature difference.

Figure 13:
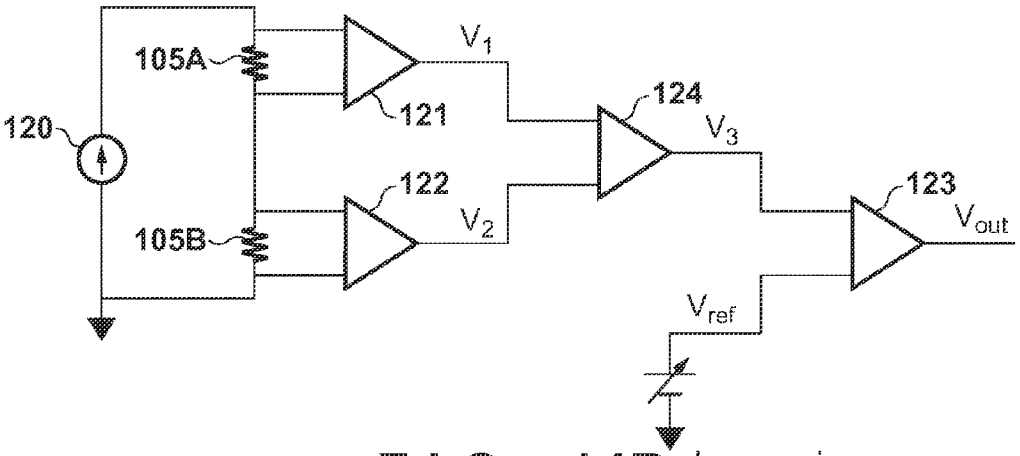
FIG. 13 is a circuit diagram showing the arrangement of a temperature detection circuit according to the third embodiment of the present invention.

FIG. 13 is a circuit diagram showing the arrangement of a temperature detection circuit according to the third embodiment of the present invention.

The same reference numerals as those in FIG. 7 denote the same components in FIG. 13 and a description thereof will be omitted.

As shown in FIG. 13, in this embodiment, the difference between voltages $V_1$ and $V_2$ of two temperature detection elements is compared with a reference voltage $V_{ref}$. In this embodiment, potential differences across two temperature detection elements 105A and 105B are extracted as $V_1$ and $V_2$. Furthermore, a subtractor 124 extracts a voltage $V_3$ given by $V_1-V_2$. The comparator 123 compares the voltage $V_3$ with the reference voltage $V_{ref}$.

Figure 14B:
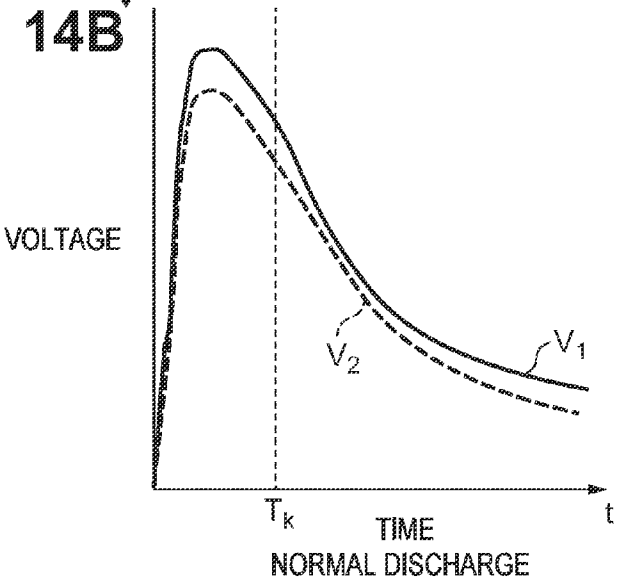
FIGS. 14A and 14B are graphs showing temporal changes in voltages of two temperature detection elements in ink discharge failure and those in normal discharge, respectively, in a case where the temperature detection circuit shown in FIG. 13 is used.
Figure 14A:
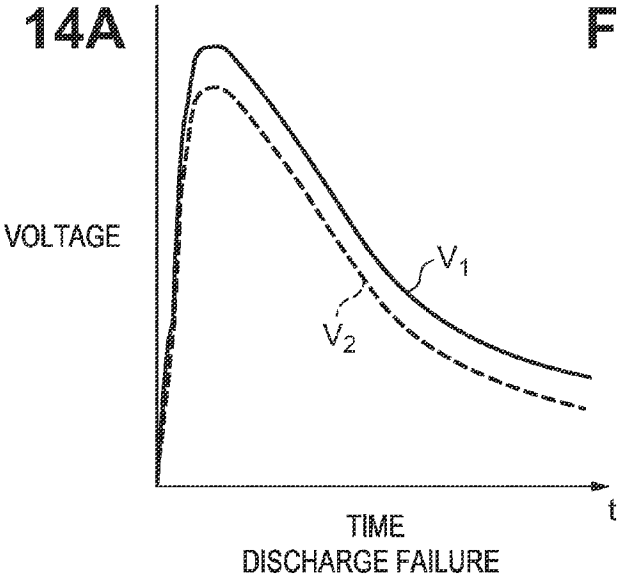

FIGS. 14A and 14B are graphs showing temporal changes in voltages of the two temperature detection elements in ink discharge failure and those in normal discharge, respectively, in a case where the temperature detection circuit shown in FIG. 13 is used.

As shown in FIGS. 14A and 14B, the magnitude relationship between the output voltages of the two temperature detection elements 105A and 105B may remain unchanged even in discharge failure (FIG. 14A) or normal discharge (FIG. 14B). In the example shown in FIGS. 14A and 14B, in ink discharge failure and in normal discharge, $V_1>V_2$ always holds. However, in normal discharge, after a timing $T_k$ at which part of a discharged ink droplet comes into contact with the surface of the anti-cavitation film 113, $V_1$ largely decreases.

Figure 15:
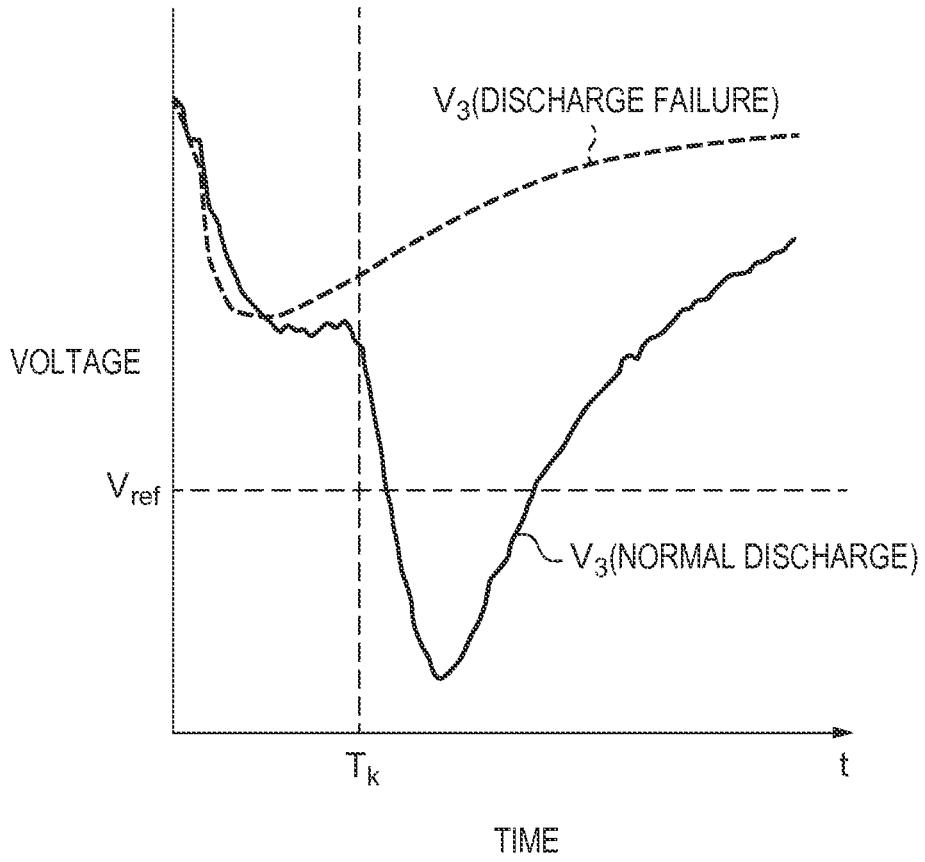
FIG. 15 is a graph showing the relationship between a reference voltage and a temporal change in output voltage from a subtractor in ink discharge failure and that in normal discharge in a case where the temperature detection circuit shown in FIG. 13 is used.

FIG. 15 is a graph showing the relationship between the reference voltage and a temporal change in output voltage from the subtractor in ink discharge failure and that in normal discharge in a case where the temperature detection circuit shown in FIG. 13 is used.

There is almost no difference between $V_1$ and $V_2$ in ink discharge failure, as shown in FIG. 14A. Thus, the voltage $V_3$ does not largely change, as shown in FIG. 15. On the other hand, in normal ink discharge, $V_1$ largely decreases after the time $T_k$, as shown in FIG. 14B. Consequently, the voltage $V_3$ becomes small, as shown in FIG. 15.

According to the above-described embodiment, therefore, based on the voltage $V_3$ in normal ink discharge and that in ink discharge failure, a voltage for determining these two statuses is set in advance as the reference voltage $V_{ref}$. It is then possible to determine the ink discharge status based on the magnitude relationship obtained by comparison with the reference voltage. That is, if $V_3<V_{ref}$, normal discharge is determined. On the other hand, if $V_3>V_{ref}$, a discharge failure is determined.

Fourth Embodiment

A case in which two temperature detection elements are formed in different layers on the Si base 108 will be described. Since the magnitude relationship between the temperatures of two temperature detection elements 105A and 105B also changes in a direction perpendicular to the surface of an anti-cavitation film 113 in accordance to the ink discharge status, it is possible to determine the ink discharge status based on the magnitude relationship between the output voltages of the two temperature detection elements.

As shown in FIGS. 4A and 4B, in ink discharge failure, the surface of the anti-cavitation film 113 is always covered with air having low heat conductivity to enter an adiabatic condition, and thus the temperature is in the highest stage. On the other hand, in normal ink discharge, since part of a discharged ink droplet having high heat conductivity comes into contact with the surface of the anti-cavitation film, the surface temperature of the anti-cavitation film 113 lowers, and the temperature of a portion below the surface of the anti-cavitation film becomes higher than that of the surface. Therefore, the magnitude relationship between the temperatures of the two temperature detection elements formed in the different layers changes depending on the ink discharge status. It is possible to determine the ink discharge status by providing the circuit arrangement shown in FIG. 7 which is the same as that in the first embodiment.

Figure 16A:
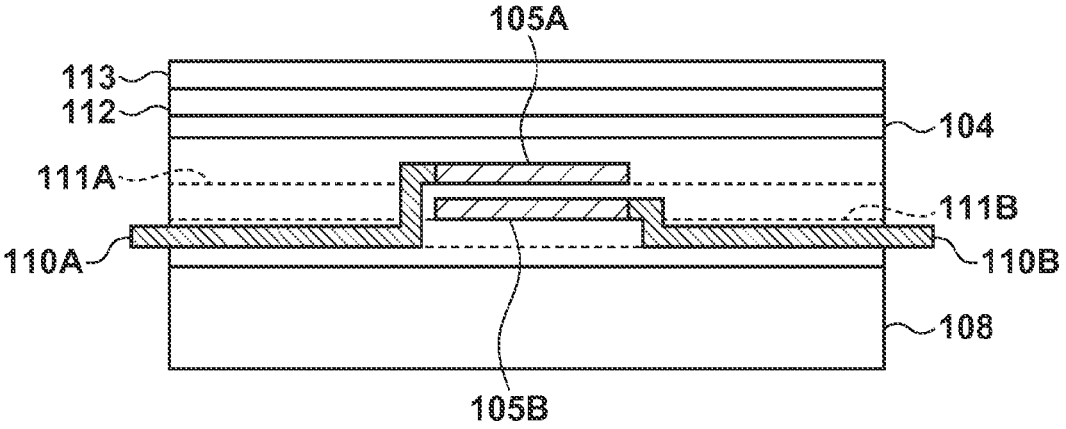
FIGS. 16A and 16B are a side sectional view and plan view, respectively, showing the arrangement of temperature detection elements and a heater according to the fourth embodiment of the present invention.
Figure 16B:
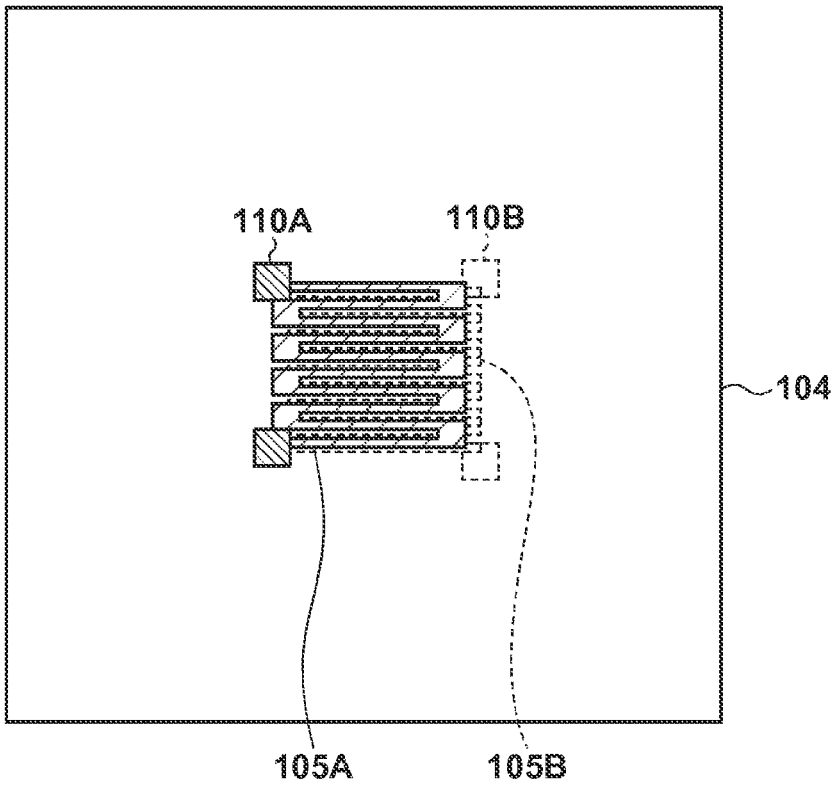

FIGS. 16A and 16B are a side sectional view and plan view, respectively, showing the arrangement of the temperature detection elements and a heater according to the fourth embodiment of the present invention.

In this embodiment, the two temperature detection elements 105A and 105B are formed in the different layers. As shown in FIG. 16A, a first interlayer insulation film 111A is formed immediately below the first temperature detection element 105A, and the second temperature detection element 105B is formed immediately below the interlayer insulation film 111A. Furthermore, a second interlayer insulation film 111B is formed immediately below the second temperature detection element 105B. The interconnection for connecting each temperature detection element can be connected to a position away from the other temperature detection element in order to avoid thermal radiation from the interconnection. Furthermore, this interconnection is short to prevent thermal radiation.

In the example shown in FIGS. 16A and 16B, an interconnection 110A connected to the first temperature detection element 105A extends leftward, and an interconnection 110B connected to the second temperature detection element 105B extends rightward.

In the plan view shown in FIG. 16B, the second temperature detection element 105B is depicted by dotted lines. The second temperature detection element 105B is arranged at a position overlapping the first temperature detection element 105A when viewed from above but is actually formed in the layer lower than that of the first temperature detection element 105A. Each of the interconnections 110A and 110B respectively connected to the two temperature detection elements is connected to an interconnection in another layer from a position at which the interconnection is reversed through 180° via the temperature detection element.

Fifth Embodiment

A case in which two temperature detection elements are formed in the same shape in the same layer of the Si base 108 will be described. According to this embodiment, by forming the temperature detection elements in the same shape in the same layer, it is possible to equalize parasitic capacitances generated between the elements and a layer in which a heater 104 is formed. When an electric current flows through the heater 104, the influences of noise components via the generated parasitic capacitances can be equalized. Therefore, according to this embodiment, when a differentiator performs a differential operation for output voltages from the two temperature detection elements, on which noise components of the same magnitude are respectively superimposed, the noise voltage components can be canceled, thereby reducing the influences of the noise components.

Figure 17:
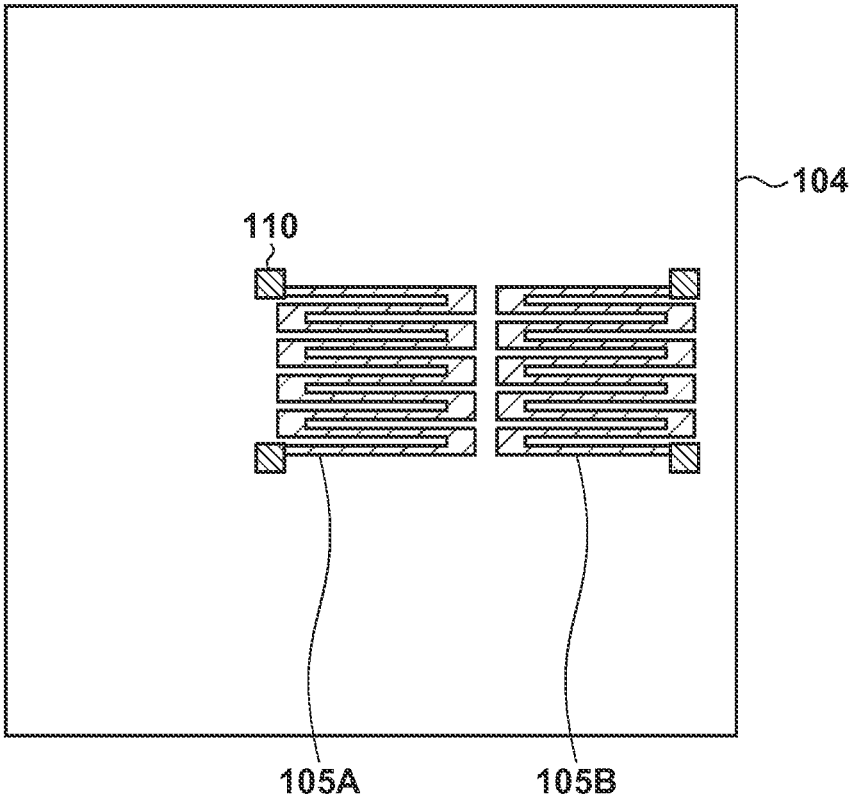
FIG. 17 is a plan view showing the arrangement of temperature detection elements and a heater according to the fifth embodiment of the present invention.

FIG. 17 is a plan view showing the arrangement of the temperature detection elements and heater according to the fifth embodiment of the present invention. In this embodiment, as described above, the two temperature detection elements 105A and 105B are formed in the same shape in the same layer. Since the two temperature detection elements are formed in the same layer, they exist at the same distance to the layer in which the heater is formed. Since the two temperature detection elements have the same shape, the surface areas of the two temperature detection elements are equal to each other. Since the two temperature detection elements have the equal surface areas and the equal distances to the layer in which the heater is formed, they have equal parasitic capacitances with respect to the layer in which the heater is formed. The cross section in a case where the two temperature detection elements are formed in the same shape in the same layer is as shown in FIG. 4A.

Figure 18A:
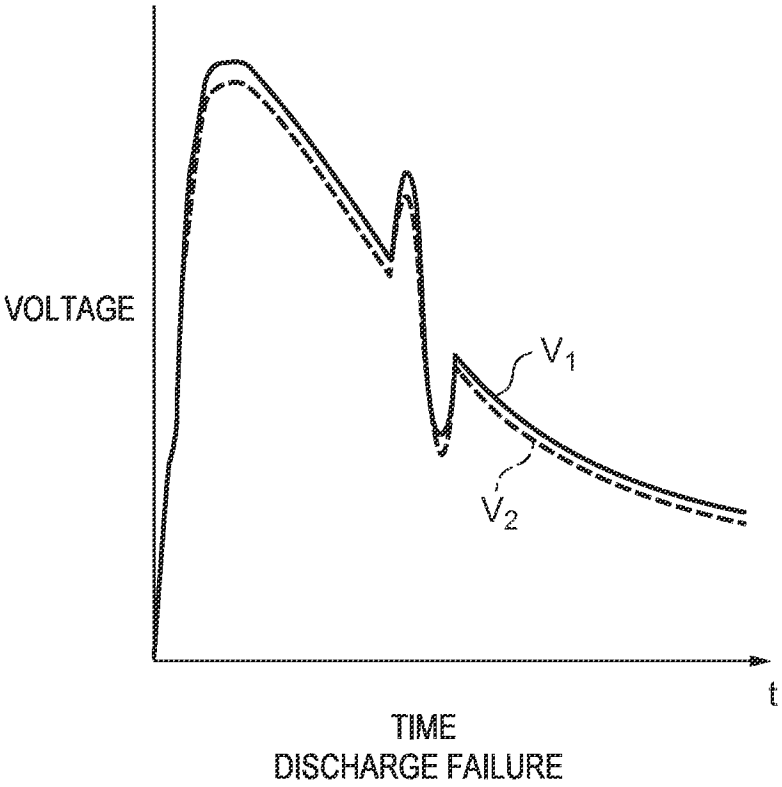
FIGS. 18A and 18B are graphs showing temporal changes in voltages of two temperature detection elements in ink discharge failure and those in normal discharge, respectively, in a case where the circuit shown in FIG. 17 is used.
Figure 18B:
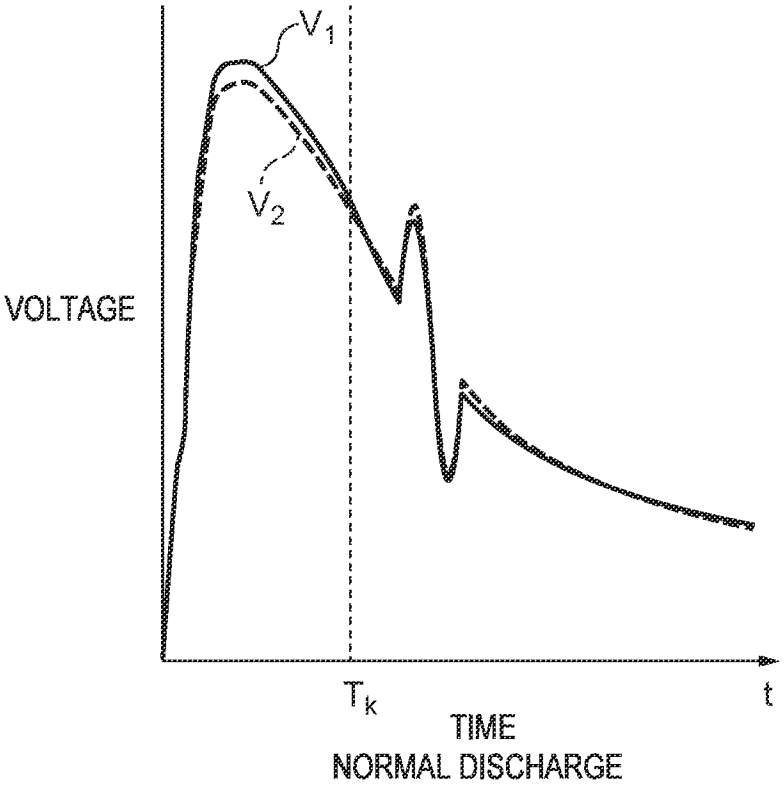

FIGS. 18A and 18B are graphs showing temporal changes in voltages of the two temperature detection elements in ink discharge failure and those in normal discharge, respectively, in a case where the circuit shown in FIG. 17 is used. Especially, each of FIGS. 18A and 18B shows temporal changes in output voltages from the two temperature detection elements when noise components via the parasitic capacitances from the heater are superimposed. As shown in FIGS. 18A and 18B, noise components of the same magnitude are respectively superimposed on a voltage $V_1$ of the first temperature detection element 105A arranged at the center of the heater 104 and a voltage $V_2$ of the second temperature detection element arranged in the periphery of the heater 104. This is because parasitic capacitances of the same magnitude with respect to the layer of the heater 104 as a noise source are generated.

As shown in FIG. 18B, in normal ink discharge, the voltage $V_1$ of the first temperature detection element largely decreases from a time $T_k$ after the timing at which part of a discharged ink droplet comes into contact with the surface of an anti-cavitation film. To the contrary, as shown in FIG. 18A, in ink discharge failure, the voltage $V_1$ does not abruptly decrease.

Figure 19:
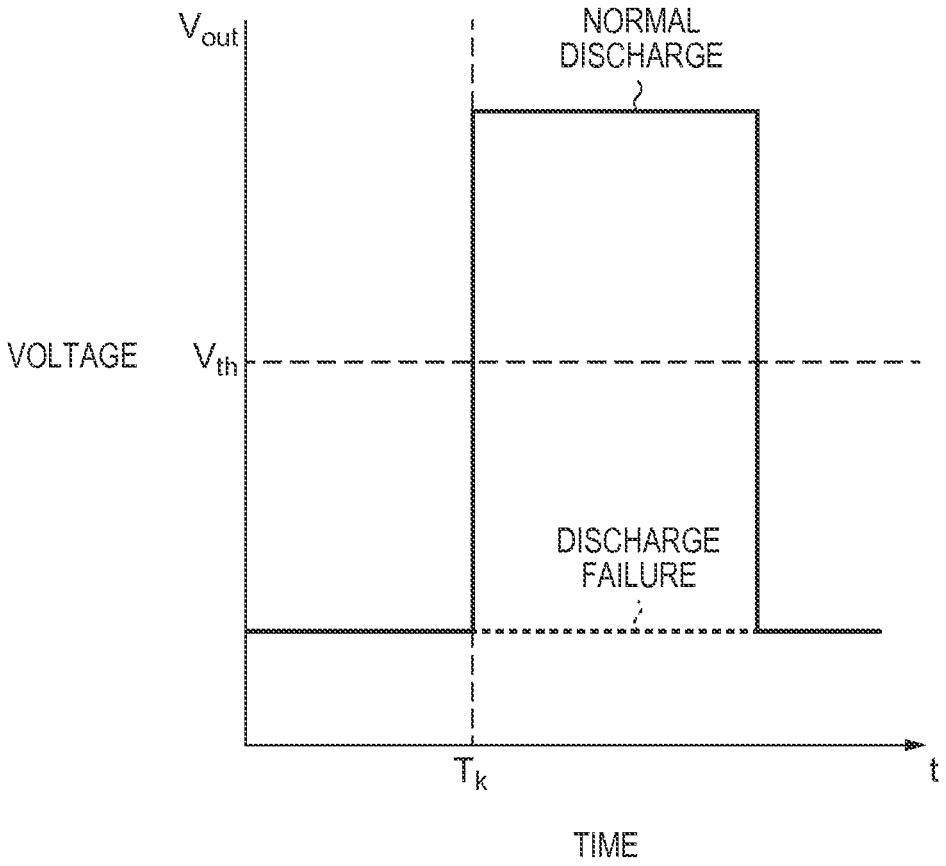
FIG. 19 is a graph showing a temporal change in output voltage from a comparator in ink discharge failure and that in normal discharge in a case where the circuit shown in FIG. 17 is used.

FIG. 19 is a graph showing a temporal change in output voltage from a comparator in ink discharge failure and that in normal discharge in a case where the circuit shown in FIG. 17 is used.

In the arrangement according to this embodiment, since noise components of the same magnitude are respectively superimposed on the voltages $V_1$ and $V_2$, the noise components are canceled by a differential operation of the differentiator, and an output result is not influenced by the noise. As a result, in normal ink discharge, an output voltage $V_{out}$ of the comparator is at high level after the time $T_k$. On the other hand, in ink discharge failure, the output voltage $V_{out}$ is always at low level.

Therefore, it is possible to correctly determine the ink discharge status by monitoring the output voltage of the comparator.

Sixth Embodiment

A case in which one of two temperature detection elements is arranged immediately below the center of a heater and the other is arranged immediately below the ink port side of the heater instead of respectively arranging the two temperature detection elements immediately below the center and periphery of the heater will be described. By arranging the two temperature detection elements as described above, it is possible to detect a temperature difference between the center of an anti-cavitation film 113 and the ink port side at the time of ink supply. It is then possible to detect the presence/absence of ink refill based on the temperature difference. Even if, therefore, part of a discharged ink droplet does not come into contact with the surface of the anti-cavitation film, it can be determined whether ink is normally discharged.

Figure 20B:
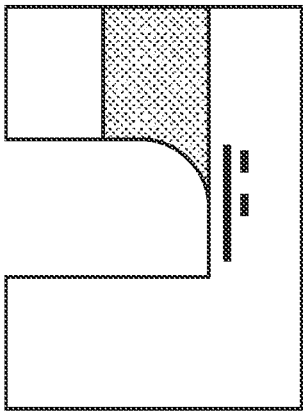
FIGS. 20A and 20B are side sectional views showing the presence/absence of ink refill within a pressure chamber of one nozzle of a liquid discharge head in ink discharge failure and that in normal discharge according to the sixth embodiment of the present invention, respectively.
Figure 20A:
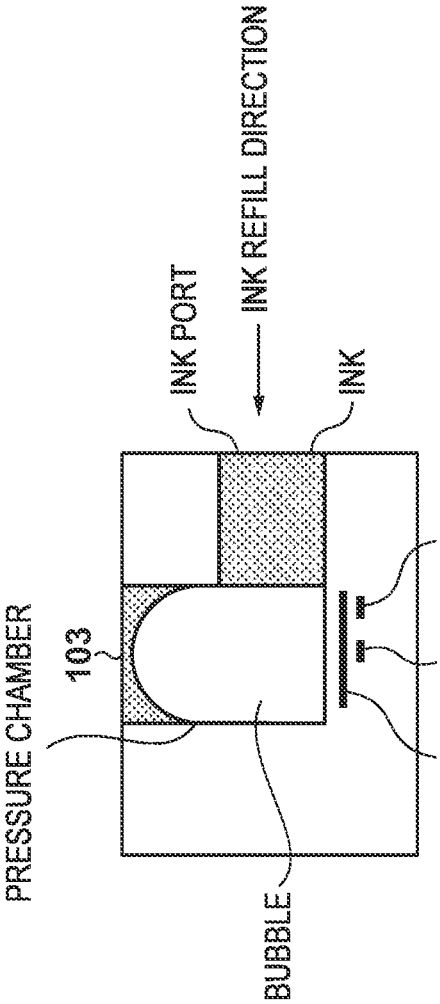

FIGS. 20A and 20B are side sectional views, respectively, showing the presence/absence of ink refill within a pressure chamber of one nozzle of a liquid discharge head in ink discharge failure and that in normal discharge according to the sixth embodiment of the present invention.

FIG. 20A shows a typical example in ink discharge failure, and shows an example of non-discharge caused by bubble in which a bubble always remains in the pressure chamber, thereby not discharging ink. At the time of non-discharge caused by bubble, since a bubble always exists in the pressure chamber, no normal ink refill is performed. In a case where no ink refill is performed, no ink is in contact with any positions on the surface of the anti-cavitation film 113, and air is always in contact with the surface of the anti-cavitation film.

On the other hand, FIG. 20B shows an example in normal ink discharge. In normal ink discharge, ink refill is normally performed. In a case where ink refill is performed, ink flows through the surface of the anti-cavitation film 113 from the ink port side, and thus the ink gradually comes into contact with the surface of the anti-cavitation film 113 from the ink port.

Figure 21:
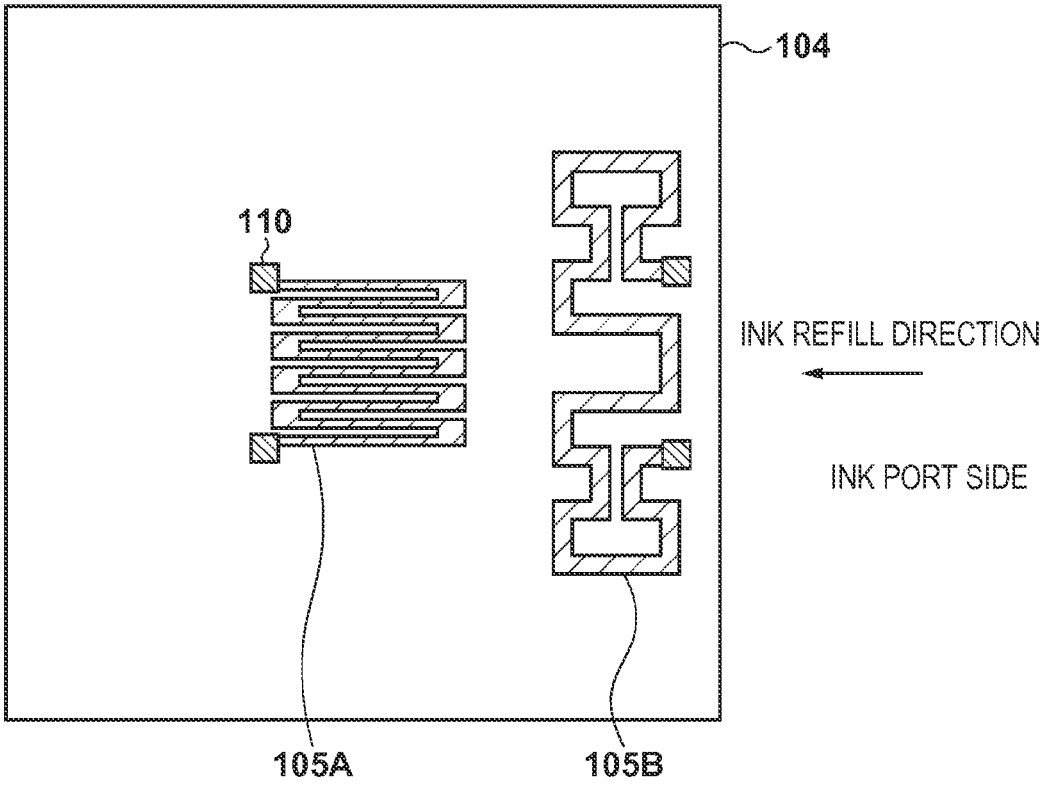
FIG. 21 is a plan view showing the arrangement of temperature detection elements and a heater according to the sixth embodiment of the present invention.

FIG. 21 is a plan view showing the arrangement of the temperature detection elements and heater according to the sixth embodiment of the present invention. Especially, FIG. 21 shows the arrangement of the temperature detection elements each configured to detect the ink discharge status based on the presence/absence of ink refill. As shown in FIG. 21, a first temperature detection element 105A is arranged immediately below the center of a heater 104, and a second temperature detection element 105B is arranged immediately below the ink port side.

In the arrangement shown in FIG. 21, in a case where no ink refill is performed, air having low heat conductivity exists on the surface of the anti-cavitation film 113, and thus the temperatures of the two temperature detection elements do not abruptly change. Therefore, the temperature difference between the two temperature detection elements is small. On the other hand, in a case where ink refill is performed, ink having high heat conductivity exists on the ink port side, and thus the temperature of the second temperature detection element 105B abruptly lowers, as compared with the first temperature detection element 105A. Consequently, the temperature difference between the two temperature detection elements becomes large.

According to the above-described embodiment, therefore, it is possible to determine the ink discharge status by providing in advance a threshold (Tth) for normal ink discharge and discharge failure with respect to the temperature difference ($\Delta T$) between the two temperature detection elements. That is, if the temperature difference is larger than the threshold ($\Delta T \geq Tth$), ink refill is normally performed, and normal discharge is determined. On the other hand, if the temperature difference is smaller than the predetermined threshold ($\Delta T < Tth$), no ink refill is normally performed, and discharge failure is determined.

Seventh Embodiment

A case in which interconnections for connecting the two temperature detection elements and the differentiator are formed not in different layers but in the same layer on the Si base 108 will be described. By forming the interconnections in the same layer, the number of base manufacturing processes can be decreased, thereby contributing to cost reduction. At this time, to prevent heat transfer between the two temperature detection elements caused by thermal radiation from the interconnections, the interconnection from each of the two temperature detection elements is desirably formed in a location where the other temperature detection element and the interconnection connected to it do not exist.

Figure 22A:
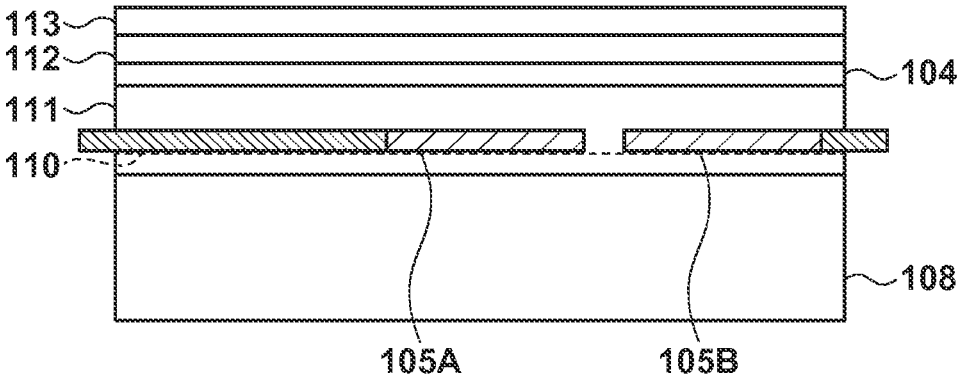
FIGS. 22A and 22B are a side sectional view and plan view, respectively, showing the arrangement of temperature detection elements and a heater according to the seventh embodiment of the present invention.
Figure 22B:
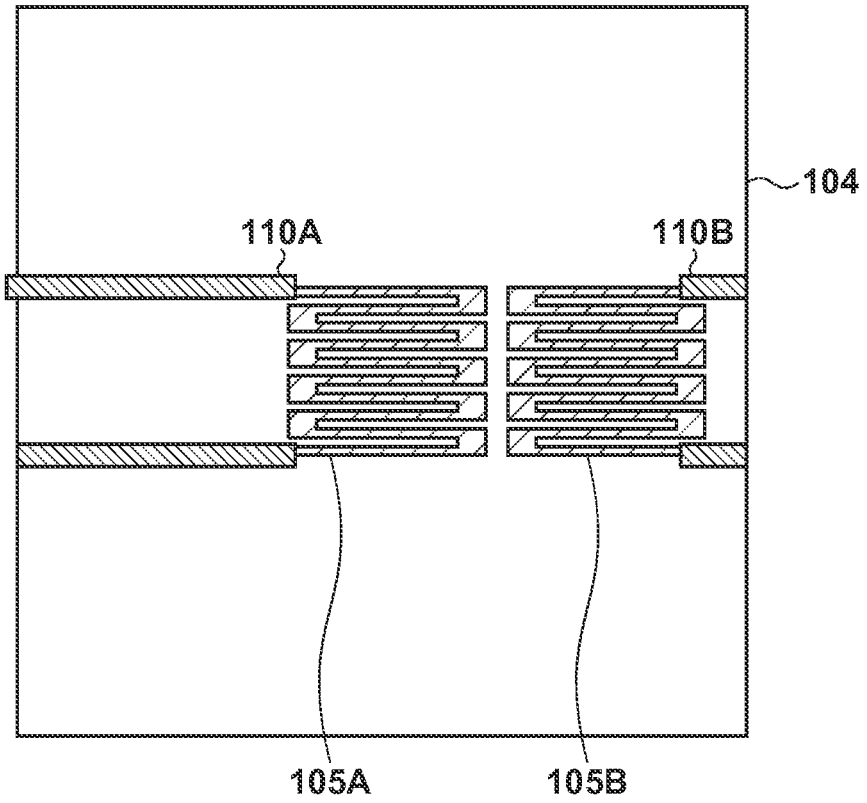

FIGS. 22A and 22B are a side sectional view and plan view, respectively, showing the arrangement of the temperature detection elements and a heater according to the seventh embodiment of the present invention.

The sectional view of FIG. 22A shows a case in which the interconnections are formed in the same layer as that of the temperature detection elements. In this example, the two temperature detection elements and the interconnections connected to them are formed in the same layer immediately below the interlayer insulation film 111.

The plan view of FIG. 22B shows a case in which each of two interconnections 110A and 110B extends from a corresponding one of two temperature detection elements 105A and 105B in a direction away from the other temperature detection element, and is laid to the outside of the region of a heater 104.

In each of the seven embodiments described above, a case in which two temperature detection elements are arranged for one heater and the ink discharge status is determined has been explained. However, these embodiments are applicable to all the nozzles of a liquid discharge head at appropriate timings, as a matter of course. As for an execution timing, for example, the processing may be executed during a printing operation or at the time of preliminary discharge. In any case, the discharge status determination processing is executed along with the discharge operation of each nozzle, so a nozzle in which ink discharge failure has occurred can be specified at high accuracy.

The arrangement according to each of the seven embodiments described above does not require any complicated operation such as a temporal differential operation. Since, therefore, every arrangement does not require any complicated circuit arrangement, it can be implemented by a low-cost simple arrangement. Furthermore, since no complicated operation is required, the determination processing can be performed at high speed. Since the circuit arrangement is not complicated, the circuit area can be made small.

In addition, recovery processing can be executed quickly in response to detection of discharge failure, or an operation of complementing printing by another nozzle can be executed quickly. Furthermore, decision of an optimum driving pulse, protection processing for the liquid discharge head from a temperature rise or the like, a warning to the user, and the like can also be executed quickly.

An example in which the present invention is applied to the printing apparatus configured to perform serial printing has been explained. However, the present invention is applicable to even a printing apparatus using a full-line liquid discharge head, as a matter of course. In this printing apparatus, the printing operation is very fast, and it is impossible to position the liquid discharge head to the recovery unit during a series of printing operations and perform recovery processing. The present invention is therefore effective in quickly specifying a nozzle in which discharge failure has occurred during preliminary discharge to the cap or the printing operation, and quickly performing recovery processing or complementation of printing by another line-shaped liquid discharge head.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-098051, filed May 9, 2014, which is hereby incorporated by reference herein in its entirety.

What is claimed is:

1. A liquid discharge head comprising:

a first nozzle discharging liquid;

a second nozzle discharging liquid; and a base comprising:

a first electrothermal transducer arranged correspondingly to the first nozzle and configured to supply heat to liquid;

a first temperature detection element arranged to overlap the first electrothermal transducer from a viewpoint of a liquid discharge direction;

a second temperature detection element arranged to overlap the first electrothermal transducer from the viewpoint of the liquid discharge direction;

a second electrothermal transducer, arranged correspondingly to the second nozzle and configured to supply heat to liquid;

a third temperature detection element arranged to overlap the second electrothermal transducer from the viewpoint of the liquid discharge direction; and a fourth temperature detection element arranged to overlap the second electrothermal transducer from the viewpoint of the liquid discharge direction.

2. The liquid discharge head according to claim 1, wherein the base has a multilayer structure, and a layer in which the first electrothermal transducer and the second electrothermal transducer are formed is different from a layer in which the first temperature detection element, the second temperature detection element, the third temperature detection element and the fourth temperature detection element are formed.

3. The liquid discharge head according to claim 2, wherein the first temperature detection element, the second temperature detection element, the third temperature detection element, and the fourth temperature detection element are formed in a same layer.

4. The liquid discharge head according to claim 3, wherein the second temperature detection element and the fourth temperature detection element are formed to surround peripheries of the first temperature detection element and the third temperature detection element, respectively.

5. The liquid discharge head according to claim 3, wherein the first temperature detection element, the second temperature detection element, the third temperature detection element, and the fourth temperature detection element are formed in a same shape.

6. The liquid discharge head according to claim 5, wherein the first temperature detection element, the second temperature detection element, the third temperature detection element, and the fourth temperature detection element are formed to have equal surface areas.

7. The liquid discharge head according to claim 2, wherein the first temperature detection element and the second temperature detection element are formed in different layers.

8. The liquid discharge head according to claim 2, further comprising:

first and second ports configured to supply the liquid to the first and second nozzles, respectively, wherein each of the first and third temperature detection elements is arranged near one of the nozzles and each of the second and fourth temperature detection elements is arranged near one of the ports.

9. The liquid discharge head according to claim 2, further comprising:

a first interconnection connected to the first and third temperature detection elements; and a second interconnection connected to the second and fourth temperature detection elements.

10. The liquid discharge head according to claim 9, wherein the first interconnection is formed in a layer different from that in which the first and third temperature detection elements are formed, and the second interconnection is formed in a layer different from that in which the second and fourth temperature detection elements are formed.

11. The liquid discharge head according to claim 9, wherein the first interconnection is formed in the same layer as that in which the first and third temperature detection elements are formed, and the second interconnection is formed in the same layer as that in which the second and fourth temperature detection elements are formed.

12. The liquid discharge head according to claim 1, wherein the first temperature detection element, the second temperature detection element, the third temperature detection element, and the fourth temperature detection element are resistors, and further comprising comparators configured to compare a first output voltage and a second output voltage obtained from the first temperature detection element, the second temperature detection element, the third temperature detection element, and the fourth temperature detection element by supplying an electric current to each of the first temperature detection element, the second temperature detection element, the third temperature detection element, and the fourth temperature detection element from outside.

13. The liquid discharge head according to claim 12, further comprising subtractors configured to subtract the second output voltage from the first output voltage, wherein the comparators compare a subtraction result obtained from the subtractors with a predetermined reference voltage.

14. A printing apparatus for printing, using a liquid discharge head according to claim 12, comprising:

an electric current supply source configured to supply an electric current to the first temperature detection element, the second temperature detection element, the third temperature detection element, and the fourth temperature detection element; and a determination unit configured to determine, based on a voltage output from the comparators, whether discharge failure occurs or liquid is normally discharged by supplying heat by the first and second electrothermal transducers corresponding to the first temperature detection element, the second temperature detection element, the third temperature detection element, and the fourth temperature detection element.

15. The apparatus according to claim 14, wherein the electric current supply source is common to the first temperature detection element, the second temperature detection element, the third temperature detection element, and the fourth temperature detection element.

16. The apparatus according to claim 14, wherein the electric current supply source is an individual electric current supply source for each of the first temperature detection element and the second temperature detection element and can individually control an electric current supplied to each of the first temperature detection element and the second temperature detection element.

17. The apparatus according to claim 14, wherein the determination unit determines that the liquid is normally discharged if a level of the output voltage from the comparators changes, and determines that liquid discharge failure occurs if the level of the output voltage from the comparators remains unchanged.

18. A method for determining a liquid discharge status in a printing apparatus for printing, using a liquid discharge head according to claim 12, comprising:

supplying an electric current to the first temperature detection element, the second temperature detection element, the third temperature detection element, and the fourth temperature detection element; and determining, based on a voltage output from the comparators, whether discharge failure occurs or liquid is normally discharged by supplying heat by one of the first and second electrothermal transducers corresponding to one of the first and third temperature detection elements and one of the second and fourth temperature detection elements.

* * * * *